US006332439B2

(12) United States Patent
Sekiya et al.

(10) Patent No.: US 6,332,439 B2
(45) Date of Patent: Dec. 25, 2001

(54) VANE TYPE HYDRAULIC ACTUATOR

(75) Inventors: Mutsuo Sekiya, Tokyo; Katsuyuki Fukuhara, Hyogo; Masafumi Sugawara, Tokyo, all of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/904,861

(22) Filed: Jul. 16, 2001

Related U.S. Application Data

(62) Division of application No. 09/439,281, filed on Nov. 15, 1999.

(30) Foreign Application Priority Data

Dec. 7, 1998 (JP) ..... 10-347523
Jul. 27, 1999 (JP) ..... 11-212475

(51) Int. Cl.[7] ..... F01L 1/344

(52) U.S. Cl. ..... 123/90.17; 74/568 R; 464/2; 464/160

(58) Field of Search ..... 123/90.15, 90.17, 123/90.31; 74/568 R; 464/1, 2, 160

(56) References Cited

U.S. PATENT DOCUMENTS 5,813,378 * 9/1998 Sato ..... 123/90.17
5,924,395 * 7/1999 Moriya et al. ..... 123/90.15
5,943,989 8/1999 Kira ..... 123/90.17
6,024,061 * 2/2000 Adachi et al. ..... 123/90.17
6,053,139 4/2000 Eguchi et al. ..... 123/90.17
6,058,897 5/2000 Nakayoshi ..... 123/90.17
6,173,687 * 1/2001 Fukuhara et al. ..... 123/90.17

FOREIGN PATENT DOCUMENTS 196 23 818 12/1996 (DE) .
199 14 767 10/1999 (DE) .
821 138 1/1998 (EP) .
859 130 8/1998 (EP) .
9-60507 3/1997 (JP) .

* cited by examiner

*Primary Examiner*—Weilun Lo
(74) *Attorney, Agent, or Firm*—Sughrue Mion, PLLC

(57) ABSTRACT

The vane type hydraulic actuator according to the present invention comprises a guide locking mechanism (guide stopper pin) (1) for guiding the rotor (44) to a locking position where the rotor (44) can be locked to the case (43), and a retaining locking mechanism (retaining stopper pin) (4) for retaining the rotor (44) to the case (43), after the rotor (44) is guided to the locking position. The actuator having vanes, wherein the length in the peripheral direction of the tip portion of the vane having the locking mechanism is substantially identical to that of the vane which is located symmetrically thereto. The length in the peripheral direction of the tip portion of the other vanes is shorter than that of the vane having the locking mechanism.

1 Claim, 18 Drawing Sheets

VANE TYPE HYDRAULIC ACTUATOR

This is a divisional of application Ser. No. 09/439,281 (Confirmation No. To be assigned) filed Nov. 15, 1999, the disclosure of which is incorporated herein by reference.

BACKGROUND OF THE INVENTION

1. Field of the Invention

The present invention relates to a vane type hydraulic actuator for controlling the timing of opening and closing of an intake and/or exhaust valve, corresponding to an operational state of an engine.

2. Description of the Prior Art

FIG. 18 is a cross sectional view of a vane type hydraulic actuator invented by the inventors of this application and is disclosed in JP-9-314069-A. FIG. 19 is a detailed cross sectional view of the plunger part shown in FIG. 18. FIG. 20 is a cross sectional view of the plunger part in a state that a hydraulic pressure is applied.

Reference numeral 19 denotes an intake side cam shaft having an intake side cam 19*a*. An actuator 40 is connected to an end of the intake side cam shaft 19, and a timing pulley 21 is disposed around the actuator 40. The working oil of the actuator 40 is lubrication oil, delivered from an engine (not shown). The actuator is actuated by the working oil so as to adjust phase angle of the rotation of the intake side cam shaft 19 so that the opening and closing timings of intake valves of the engine can be continuously adjusted. The intake side cam shaft 41 is supported by a bearing 19. The actuator 40 has a housing 42, which can freely rotate around the intake side cam shaft 19.

A case 43 is fixed to the housing 42. And a vane type rotor 44 is received in the case 43. The vane rotor 44 is fixed to the intake side cam shaft 19 by means of bolts 45. The rotor 44 is rotatable relative to the case 43 in a predetermined anglular region.

The case 43 and the rotor 44 form hydraulic pressure chambers separated from each other. A chip seal 46 is disposed between the case 43 and the rotor 44 so that no oil leakage between the oil pressure chambers can occur. A back spring 47 made of an iron plate is disposed to push the chip seal 46 towards the rotor 44.

The housing 42, the case 43 and a cover 48 connected to the case 43 are fixed by a common volt 49. An O-ring 50 is disposed between the case 43 and the bolt 50. A plate 51 is fixed to the cover 48 by a bolt 52. Reference numerals 53, 54 denote O-rings. A cylindrical holder 55 is disposed in the rotor 44. The cylindrical holder 55 has an engaging hole 55a, which can engage with a plunger 56, as will be explained below.

The plunger 56 disposed in the housing 42 can slide therein and has an engaging shaft 56a, which can engage with the engaging hole 55*a* of the holder 55. The plunger 56 is pushed by a spring 57 towards the holder 55. Working oil is delivered into the engaging hole 55*a* of the holder 55 through a plunger oil channel 58. When working oil is delivered into the engaging hole 55*a* of the holder 55, the plunger 56 moves opposingly to the spring 57 so that the plunger 56 is unlocked from the holder 55. The rotor 44 is fixed to the intake side cam shaft 19 by means of a bolt 60. Reference numerals 59, 61 denote air holes.

A first and second oil channels 62, 63 are disposed in the intake side cam shaft 19 and the rotor 44. The first oil channel 62 communicates with an oil pressure chamber for timing retard 73, and the second oil channel 63 communicates with an oil pressure chamber for timing advance 74.

The amount of the working oil to be delivered to the actuator 40 is controlled by an oil control valve 80, which will be abbreviated to OCV hereinafter.

The OCV 80 comprises a valve housing 81, a spool 82 which can slide in the valve housing 81, a spring 83 urging the spool 82 toward one direction, and a linear solenoid 84 for displacing the spool 82 resisting the spring 83. The OCV is connected with an oil pan 91 through an oil supplying pipe 85*a*. An oil pump 92 and an oil filter 93 are disposed in the oil supplying pipe 85*a*. The first and second oil channels 62, 63 are connected with the OCV 80 through a first and second oil pipes 89, 90, respectively. The working oil returns to the oil pan 91 from the OCV 80 through an oil drain pipe 88. The oil pan 91, the oil pump 92, the oil filter 93 are a part of a lubrication system for lubricating portions to be lubricated in the engine (not shown), and simultaneously they form a working oil delivery system to the actuator 40.

An electronic control unit 100, which is abbreviated to ECU hereinafter, controls the amount of fuel injection into the engine, the timings of the ignition, and the timing of the opening and closing of valves. The control corresponds to the inputs from an intake air amount sensor, a throttle sensor, crank angle sensor and a cam angle sensor, which are not shown. The electronic control unit 100 further controls the closing timing of valves after the switching off of the ignition switch.

FIG. 21 is a cross sectional view of FIG. 18 along the line X—X. FIG. 22 shows a state in which a slide plate shown in FIG. 21 is displaced. FIG. 23 is a cross sectional view of FIG. 18 along the line Y—Y, FIG. 24 is a cross sectional view of FIG. 18 along the line Z—Z.

As shown in the figures, a first to fourth vanes 64–67 project radially from the rotor 44. A chip seal 68 is disposed at the tip of each vane 64–67. The chip seal 68 contacts with the inner surface of the case 43 and can slide along the surface. The chip seals 68 seal between the chambers disposed at both sides of the vanes. By the way, a back spring (not shown) is disposed behind each chip seals 68 for increasing the capacity of the sealing.

Four shoes 71 project inwardly from the inner surface of the case 43. The shoe 43 has a bolt hole 72, into which the bolt 49 shown in FIG. 18 is screwed.

The tip portion of each shoe 71 contacts with a vane supporting portion 69 of the rotor, namely the hub of the rotor, which supports the vanes. The tip portion of each shoe 71 slides along the outer surface of the vane supporting portion 69. Each room between the adjacent shoes 71 is divided by the corresponding shoe 71 into an oil pressure chamber for timing retard 73 and an oil pressure chamber for timing advance 74. These chambers 73, 74 are formed alternatively and have a form of a sector like room contoured peripherally by the inner surface of the case 43 and the outer surface of the rotor 44 and contoured radially by one of the shoes 71 and one of the vanes 64–67 of the rotor 44.

The oil pressure chamber for timing retard 73 is used for swing the first to fourth vanes 64–67 so that the timing of the opening and closing of valves is retarded. And the oil chamber for timing advance 74 is used for swing the first to fourth vanes 64–67 so that the timing of the opening and closing of valves is advanced.

The oil pressure chamber for timing retard 73 and the oil pressure chamber for timing advance 74 disposed at both side of the first vane 64 are communicated through a communicating channel 75, which passes through the first vane 64. A groove 76 is disposed in the communicating channel 75, and the plunger oil channel 58 communicates with the groove 76.

A slide plate 77 is disposed in the groove 76. The slide plate 77 divides the communicating channel 75 into two parts in such a manner that the oil leakage between the oil pressure chamber for timing retard 73 and the oil pressure chamber for timing advance 74 is prevented.

The slide plate 77 moves toward the oil pressure chamber for timing advance 74, when the oil pressure in the oil pressure chamber for timing retard 73 is higher. It moves towards the oil chamber for timing retard 73, when the pressure in the oil pressure chamber for timing advance 74 is higher. The arrow marks in FIGS. 21, 23, 24 show the rotation direction of the actuator 40 as a whole.

The oil pressure chambers for timing retard and advance 73, 74 are surrounded by the housing 42, case 43, rotor 44 and cover 48. The oil pressure chamber for timing retard 73 communicates with the first oil channel 62 so that working oil is delivered to the chamber 73 through the first oil channel 62. And the oil pressure chamber for timing advance 74 communicates with the second oil channel 63 so that working oil is delivered to the chamber 74 through the second oil channel 63. The rotor 44 rotates relatively to the housing 42, when the volumes of the oil pressure chambers 73, 74 change, corresponding to the amount of working oil delivered to each of the oil pressure chambers 73, 74

The function of the actuator 40 and the OCV 80 is explained below.

At first, when the engine is stopping, the rotor 44 is positioned, as shown in FIG. 21, at the maximum timing advance position, namely, the rotor 44 has rotated at most in the timing advance direction. Also the oil pump 92 is stopping, therefore, no working oil is delivered either to the first and second oil channels 62, 63, as a result, no working oil is supplied to the plunger oil channel 58. Consequently, the oil pressure in the actuator 40 is low. As a result, the plunger 56 is pushed by the urging force of the spring 57 towards the holder 55 so that the engaging shaft 56*a* of the plunger 56 engages with the engaging hole 55a of the holder 55, that is to say, the rotor 44 is locked to the housing 42.

In this specification and Claims, a "timing advance direction" is a rotation direction of the rotor relative to the housing to advance the timing of the opening and closing of the valves, and a "timing retard direction" is a rotation direction of the rotor relative to the housing to retard the timing of the opening and closing of the valves.

Starting from this state, when the engine is started, the oil pump 92 functions to increase the oil pressure to the OCV 80 so that working oil is delivered through the first oil pipe 89 and the first oil channel 62 to the oil pressure chamber for timing retard 73 in the actuator 40. Due to the high oil pressure in the oil pressure chamber for timing retard 73, the slide plate 77 moves towards the oil pressure chamber for timing advance 74. As a result, the oil pressure chamber for timing retard 73 communicates with the plunger oil channel 58 so that the working oil is delivered through this plunger oil channel 58 into the engaging hole 55*a* of the holder 55. As a result, the plunger 56 is urged toward the spring, resisting the spring force, so that the engaging shaft 56*a* of the plunger 56 is pushed out from the engaging hole 55*a* of the holder 55*a*. That is to say, the engaging or locking between the plunger 56 and the rotor 44 is released.

Also in this state, due to the working oil delivered into the oil pressure chamber for timing retard, each vane 65–67 of the rotor 44 is pressed to a shoe 71 from the oil pressure chamber 73, and contacts with a flank of the shoe 71. Therefore, even in the unlocked state between the plunger 56 and the rotor 44, the housing 42 and the rotor 44 are pressing to each other due to the oil pressure in the oil pressure chamber for timing retard 73. As a result, the vibration or clashing in the actuator can be reduced or eliminated.

For changing the opening and closing timing of the valves, working oil is delivered from the OCV 80 to the oil chamber for timing advance 74 through the second oil pipe 90 and the second oil channel 63. The oil pressure in the oil chamber for timing advance 74 is delivered to the communicating channel 75 so that the slide plate 77 is pushed to move towards the oil pressure chamber for timing retard 73. Due to this movement of the slide plate 77, the plunger oil channel 58 communicates with the communicating channel 75 at the oil pressure chamber for timing advance 74 side so that the oil pressure in the oil pressure chamber for timing advance 74 is supplied to the plunger oil channel 58. Due to this high oil pressure, the plunger 56 moves towards the housing 42 resisting the force of the spring 57, so that the engaging or locking between the plunger 56 and the holder 55 is released.

In this unlocked state, the opening and closing of the OCV 80 is controlled so as to control the oil delivery to the oil pressure chambers for timing retard and advance 73, 74 so that the rotation angle of the rotor 44 relative to the rotation angle of the housing 42 is changed, that is to say, the rotor 44 is rotated in the timing advance direction or in the timing retard direction. For example, when the rotor 44 is rotated at most in the timing advance direction, the rotor rotates at a state that each vane 64–67 of the rotor 44 is contacting with a shoe 71 from the oil pressure chamber for timing retard 73 side, as shown in FIG. 22. When the oil pressure in the oil pressure chamber for timing retard 73 is higher than that in the oil pressure chamber for timing advance 74, the rotor 44 rotates in the timing retard direction relatively to the housing 42.

As explained above, the rotor 44 is controlled to rotate relatively to the housing 42 in the timing advance direction or in the timing retard direction, by adjusting the oil delivery to the oil pressure chambers for timing advance and retard 73, 74. The oil leakage at the oil delivery between the oil pressure chambers 73, 74 is prevented by means of chip seals 46, 68.

By the way, the oil pressure provided from the OCV 80 is controlled by the ECU 100, corresponding to the outputs from a position sensor, which detects the rotation angel of the rotor 44 relative to the housing 42, and a crank angle sensor, which determines the pressure to be supplied from the oil pump 92.

Another apparatus for adjusting the timings of the opening and closing of valves in an internal combustion engine using a vane type hydraulic actuator is disclosed in JP-9-60507-A, which employs a structure that one stopper pin, as a locking means, locks the rotor in the maximum timing retard position or in the maximum timing advance position, while the timings of the opening and closing of valves are adjusted at the starting of the engine.

As explained above, vane type actuators in the prior art employ a structure that one plunger 56 or one stopper pin, as a locking means, locks the rotor in the maximum timing retard position or in the maximum timing advance position, while the timings of the opening and closing of valves are adjusted at the starting of the engine.

In general, for optimizing the timings of opening and closing of valves in an intake/exhaust system of an engine, for example, the engine shall be started from a state, in which the rotor in the intake side is shifted a little from the maximum timing retard position towards the maximum timing advance position, and the rotor in the exhaust side is shifted a little from the maximum, timing advance position towards the maximum timing retard position. As a result, the rotors in the intake side and the exhaust side have to be locked at an intermediate position. However, the locking at an intermediate position was difficult, when the structures of the vane type hydraulic actuators in the prior art are employed. The apparatus will be of more complex, when such structure in the prior art is modified to lock the rotors in an intermediate position. That is to say, the vane type hydraulic actuator in the prior art has the drawback that an optimization of timings of opening and closing of valves using a simplified structure was impossible.

SUMMARY OF THE INVENTION

An object of the present invention is to eliminate the drawback of the vane type hydraulic actuator in the prior art.

Another object is to propose a vane type hydraulic actuator, in which the rotor can be locked securely at an arbitrary timing retard or timing advance position, when the engine is stopping, so that the timing of opening and closing of valves can be optimized.

Another object is to propose a vane type hydraulic actuator, in which an unbalanced rotation of the rotor can be prevented.

Another object is to propose a vane type hydraulic actuator, in which the assembling of the components for locking the rotor is easy.

Another object is to propose a vane type hydraulic actuator, in which the rotor can be smoothly displaced to an arbitrary position, and the displaced rotor can be securely locked at the position.

Another object is to propose a vane type hydraulic actuator, in which the relative velocity between the rotor and the case can be rapidly decreased, and simultaneously the allowance of dimensions of the components required in the assembling process can be loosened.

Another object is to propose a vane type hydraulic actuator, in which the locking of the rotor can be released smoothly, using either of the oil pressure in the oil pressure chambers for timing retard or timing advance.

Another object is to propose a vane type hydraulic actuator, in which the rotor can be held securely at any position where the locking of the rotor is released.

Another object is to propose a vane type hydraulic actuator, in which the misassembling of components of the actuator in the production process can be absolutely prevented so that the efficiency of the assembling of components of the actuator can be improved.

Another object is to propose a vane type hydraulic actuator, in which drawing back of locking elements from a rotor retaining position can be prevented.

Another object is to propose a vane type hydraulic actuator, in which, when the rotor is offset from a locking position, the offset of rotor can be corrected, and the rotor can be securely locked at the corrected locking position.

These objects are attained by a vane type hydraulic actuator according to the present invention, more specifically, a vane type hydraulic actuator comprising:

a case having a plurality of shoes and being installed on the cam shaft of an engine so as to be rotatable independently therefrom;

a rotor having a plurality of vanes and being received in the case, the rotor is fixed to the cam shaft of the engine and is rotatable relatively to the case in a predetermined angle region;

an oil pressure chambers for timing retard and for timing advance disposed between the vanes of the rotor and the shoe of the case;

and a locking means for retaining the rotor to the case so that the relative rotation between the case and the rotor is prevented;

wherein the locking means comprises:

a guide locking means for guiding the rotor to a predetermined locking position to lock the rotor to the case;

and a retaining locking means for retaining the rotor to the case after that the rotor is guided to a predetermined locking position by the guide locking means.

In an embodiment of the present invention, the guide locking means is disposed in a first vane, and the retaining locking means is disposed in a second vane located symmetrically with the first vane in respect with the axis of the rotor.

In an embodiment of the present invention, the guide locking means and the retaining locking means are disposed in either of a vane of the rotor or a shoe of the case and are arranged to be adjacent to each other in the direction of the axis of the rotor, they are configured to move in the radial direction of the rotor so that the rotor can be locked to the case and can be disengaged from the case.

In an embodiment of the present invention, the guide locking means has a first engaging boss formed as a tapered pin;

the retaining locking means has a second engaging boss formed as a parallel pin;

and the first and second bosses are received, respectively, in a first and second engaging recesses, each of which are formed so as to disengageably receive the bosses and are disposed in a portion rotating together with the case or alternately in the rotor.

In an embodiment of the present invention, the guide locking means has a first engaging boss formed as a parallel pin; a first engaging recess is disposed in a portion rotating together with the case; and a friction increasing means is disposed in the base region of the first engaging recess so that the first engaging boss can contact with the friction increasing means.

In an embodiment of the present invention, further comprising a lock releasing oil pressure channel for supplying oil pressure to the guide locking means and the retaining locking means so as to release the engagement between the rotor and the case; and an oil channel switching means for connecting the lock releasing oil pressure channel to either of the oil pressure chambers for timing retard or the oil chamber for timing advance.

In an embodiment of the present invention, a fluid channel is disposed in a portion rotating together with the case so that spaces, which are formed behind each of the guide locking means and the retaining locking means when the rotor is locked to the case, communicate to the atmosphere through the fluid channel, only when the rotor is locked to the case.

In an embodiment of the present invention, the cross section of the guide locking means is different from that of the retaining locking means.

In an embodiment of the present invention, each of the guide locking means and the retaining locking means is urged so as to lock the rotor to the case by urging means; and the urging force of the urging means for the guide locking means is designed to be stronger than that of the urging means for the retaining locking means.

In an embodiment of the present invention, the length in the peripheral direction of the tip portion of the vane having the guide locking means is substantially identical to that of the retaining locking means.

In an embodiment of the present invention, the vane having the guide locking means and/or the vane having the retaining locking means have a weight balancing hole so as to balance the rotation of the rotor.

In an embodiment of the present invention, the first engaging recess for receiving the guide locking means is tapered in such a manner that the tapering angle of the first engaging recess is larger than the tapering angle of the first engaging boss.

In an embodiment of the present invention, the first engaging recess for receiving the first engaging boss of the guide locking means is disposed in a sliding means which is resiliently held in a portion rotating together with the case.

According to the present invention, the locking means for retaining the rotor to the case is a combination of a guide locking means for guiding the rotor to a predetermined locking position and a retaining locking means for retaining the rotor to the rotor, which has been guided to the locking position. Therefore advantages are obtained in that, though the structure is simple, the rotor can be guided to a predetermined locking position using the guide locking means to lock it temporarily, and after temporarily locking, the rotor can be retained securely at an arbitrary position for a desired timing retard or for timing advance, using the retaining locking means, so that the timing of the opening and closing of the valves can be optimized.

When the guide locking means is disposed in a first vane of the rotor, and the retaining locking means is disposed in a second vane symmetrical to the first vane in respect with the axis of the rotor, unbalanced rotation of the rotor can be prevented.

When the guide locking means and the retaining locking means are designed to be disposed either in a common vane of the rotor or in a common shoe of the case, and they are arranged so as to be adjacent in the direction of the axis of the rotor, further they can move in the radial direction of the rotor, the efficiency of the production process is improved, because they can be assembled side by side. And the preciseness of the positioning of the rotor can be improved, because the rotor is temporarily locked by the guide locking means, which is found in the adjacent position of the retaining locking means.

When the guide locking means has a first engaging boss formed as a tapered pin, and the retaining locking means has a second engaging pin formed as a parallel pin; and their corresponding engaging recess, having a recessed portion corresponding to those first and second engaging boss, are disposed in either of a portion rotating together with the case or the rotor so that they receive the first and second engaging boss, the tapered first engaging boss of the guide locking means can easily enter the corresponding tapered engaging recess. Therefore the rotor can be smoothly positioned to a predetermined locking position. And even when the position of the second engaging boss, formed as a parallel pin, of the retaining locking means is offset from the corresponding engaging recess, the offset can be corrected easily using the guide locking means. After correcting the position, the second engaging boss of the retaining means enters into the second engaging recess so that the rotor can be retained securely at an arbitrary position for timing retard and the timing advance, therefore the timing of opening and closing of the valves can be optimized.

When the guide locking means has a first engaging boss formed as a parallel pin, and the first engaging recess for receiving loosely the first engaging boss is disposed in a portion rotating together with the case, further a friction increasing member is disposed in the base portion of the first engaging recess so that the first engaging boss can contact with it, the relative velocity between the rotor and the case decreases, due to the increased friction resistance between the first engaging boss and the first engaging recess. Thus, though the first engaging boss of the guide locking means is formed as a parallel pin, the retaining locking means can be easily and securely positioned to the retaining position of the rotor. And the retaining locking means can be securely driven to retain the rotor.

When the vane type hydraulic actuator comprises a lock releasing oil channel for supplying oil pressure to the guide locking means and the retaining locking means so as to release the locking, and an oil channel switching means for switching the oil channel so that the lock releasing oil channel communicates with either of the oil chambers for timing retard or for timing advance, the oil channel from either of the oil chambers for timing retard or for timing advance can be supplied securely to both of the guide locking means and the retaining locking means so that they can be securely driven.

When a fluid channel is disposed in a portion rotating together with the case so that spaces, which are formed behind the guide locking means and the retaining locking means when the rotor is locked, communicate with the atmosphere only when the rotor is locked, the guide locking means and the retaining locking means can be driven smoothly from a locking state to a locking releasing state.

When the cross sectional area of the guide locking means is different from that of the retaining locking means, misassembling of guide locking means and the retaining locking means to an erroneous position in the production process can be prevented, so that the efficiency of the production can be ameliorated.

When the urging force of the urging member for the guide locking means is designed to be stronger than that of the retaining locking means, once the first engaging boss of the guide locking means, formed as a tapered pin, engages with the first engaging recess for locking the rotor to the case, even when the rotation of rotor tends to disengage the first engaging boss from the first engaging recess, the first engaging boss does not disengage from the first engaging recess. Thus the rotor can be securely locked to a predetermined locking position. Additionally, the retaining locking means can be smoothly driven to release the locking, using small oil pressure, because the retaining locking means is urged by a small urging force.

When the peripheral length of the tip portion of the vane having the guide locking means is designed to be substantially identical to that of the vane having the retaining locking means, the unbalancing of the rotor due to the installation of the guide locking means and the retaining locking means can be prevented.

When a weight balancing hole is disposed in the first vane having the guide locking means and/or the second vane having the retaining locking means, the unbalanced rotation of the rotor due to the Installation of the guide locking means and the retaining locking means can be prevented.

When the tapering angle of the first engaging boss of the guide locking means is larger than that of the first engaging recess for receiving the first engaging boss, the first engaging boss can smoothly enter into the first engaging recess, therefore, even when the rotor is offset from the locking position, the offset can be easily and securely corrected.

When the first engaging recess for loosely receiving the first engaging boss of the guide locking means is disposed in a slide means, which is resiliently held in a portion rotating together with the case, the first engaging boss of the guide locking means can easily enter into the first, engaging recess so that the temporal positioning of the rotor using the guide locking means is easy. And the relative velocity between the rotor and the case decreases, due to the temporal positioning of the guide locking means. Therefore, the retaining locking means can be smoothly and securely driven to lock the rotor to the case.

DETAILED DESCRIPTION OF THE PREFERRED EMBODIMENT

Embodiment 1

Figure 1:
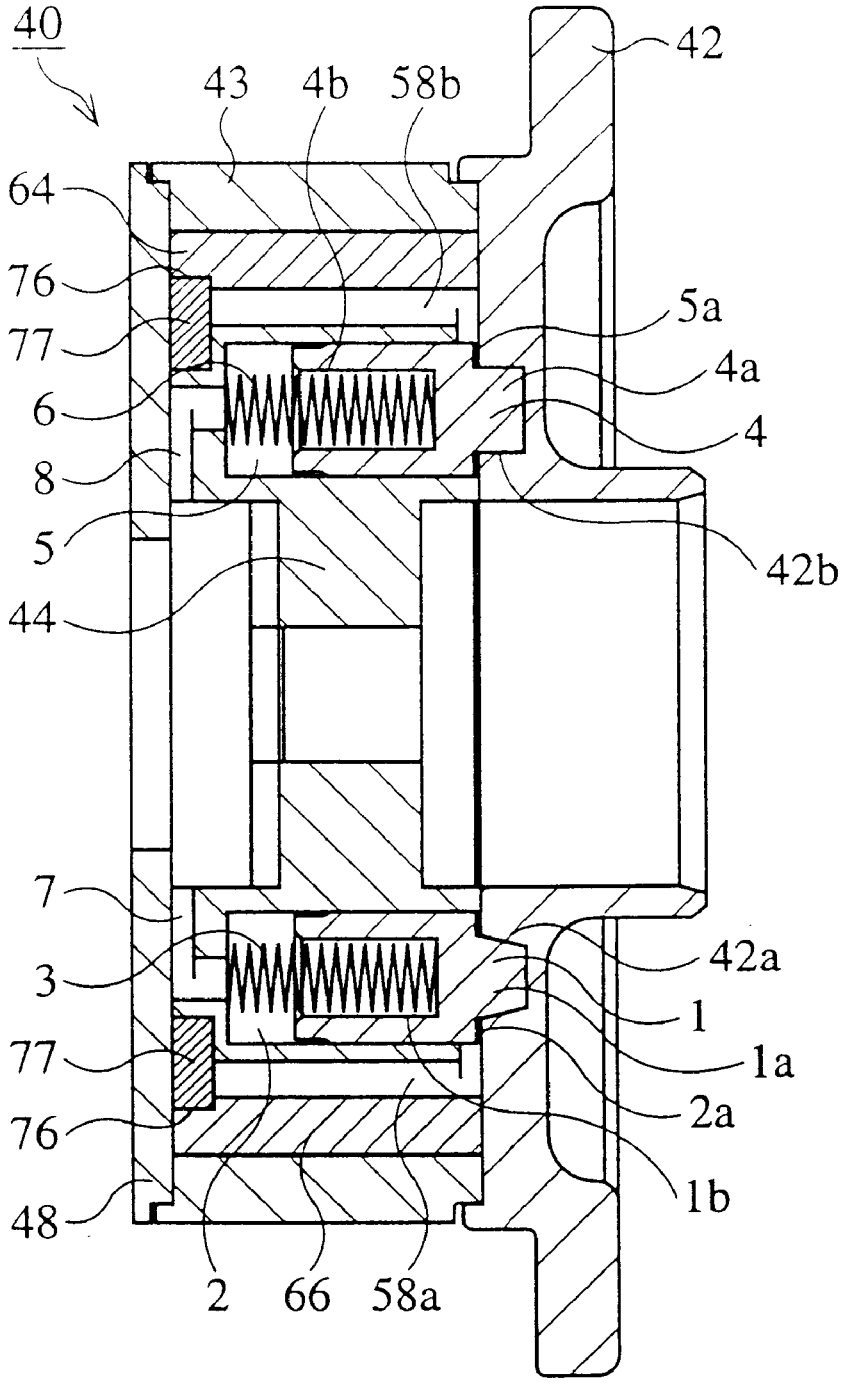
FIG. 1 is a cross sectional view of a vane type hydraulic actuator according to first embodiment of the present invention.

Embodiment 1 of the present invention is explained below, referring to FIGS. 1–6. Components in these figures equivalent or corresponding to those in FIGS. 16–22 are referred to the same reference numerals, and their explanations are omitted.

The rotor 44 is guided to a predetermined retaining position in respect with the case 43 by a guide stopper pin 1, as a guide locking means, so that a phase angle between them is corrected. The guide stopper pin 1 has a first engaging boss 1*a* at its one end, which is formed as a tapered pin so that the diameter is decreasing towards the tip direction, and a spring receiving hole 1*b* at the opposite side of the guide stopper pin 1. A first pin holding hole 2 is disposed in one vane 66 of four vanes of the rotor 44, and is configured in the longitudinal direction of the rotor. The guide stopper pin 1 is received in the first pin holding hole 2 and can slide in the hole 2.

The housing 42, which rotate together with the case 43, has a first engaging recess 42*a* on the surface where the rotor 44 contacts and slide along it. The first engaging recess 42*a* is tapered so that the diameter increases in the direction towards the opening. The first engaging boss 1*a* of the guide stopper pin 1 can be disengageably received in the first engaging recess 42*a*. The tapering angle θ 2 of the first engaging recess 42*a* is designed to be larger than the tapering angle θ 1 of the first engaging boss la so that the first engaging boss 1*a* can easily enter into the first engaging recess 42*a*.

The guide stopper pin 1 is urged by a spring 3 towards the housing 42. Namely the spring 3 functions as an urging means. When the first engaging boss 1*a* of the guide stopper pin 1 is pushed into the first engaging recess 42*a*, due to the force of the first spring 3, namely when they are engaged to each other, a first gap 2*a* is found between the housing 42 and the end surface of the guide stopper pin 1 where the first engaging boss 1*a* is disposed. The first gap 2*a* communicates with a first oil channel 58*a*, which will be explained later, so that an oil pressure can be applied to the guide stopper pin 1 in the direction resisting the force of the spring 3.

Reference numeral 4 denotes a retaining stopper pin, which functions as a retaining locking means for retaining securely the rotor 44 to the case 43, after that the phase angle between them is corrected by the guide stopper pin 1. The retaining stopper pin 4 has a second engaging boss 4*a* formed as a parallel pin at a longitudinal end thereof, and a second spring holding hole 4*b* at the other end thereof. A second pin holding hole 5 is disposed in a vane of the rotor 44, which is found at a symmetrical position of the vane 66. The second pin holding hole 5 extends along the longitudinal direction of the rotor 44, and the retaining stopper pin 4 is inserted therein so as to be able to slide in the longitudinal direction. That is to say, the guide stopper pin 1 and the retaining stopper pin 4 are disposed, respectively, in vanes 66, 64, which are configured at a substantially symmetrical position on the rotor 44 in respect with the rotation axis of the rotor 44. A second 25 engaging recess 42*b* is disposed on a surface of the housing 42 where the rotor contacts and slide thereon. The second engaging hole 42*b* has a diameter which allow to insert the second engaging boss 4*a* of the retaining stopper pin 4 and to release the engagement of the second engaging boss 4*a* therefrom.

The first engaging boss 1*a* of the guide stopper pin 1 and the first engaging recess 42*a* as well as the second engaging boss 4*a* of the retaining stopper pin 4 and the second engaging recess 42*b* are configured at, for example, a position shifted a little in the timing advance direction from the maximum timing retard position and a position shifted a little in the timing retard direction from the maximum timing advance position so that the vanes 64–67 of the rotor 44 can be locked at an arbitrary intermediate position apart from the shoes 71 of the case 43.

A second spring 6, as an urging means, presses the retaining stopper pin 4 towards the housing 42. The resilient force of the first spring 3 for the guide stopper pin 1 is designed stronger than that of the second spring 6. When the second engaging boss 4*a* of the retaining stopper pin 4 is pushed into the second engaging recess 42*b*, due to the force of the second spring 6, namely when they are engaging to each other, a second gap 5*a* is found between the housing 42 and the end surface of the retaining stopper pin 4 where the second engaging boss 4*a* is disposed. The second gap 5*a* communicates with a second oil channel 58*b*, which will be explained later, so that an oil pressure can be applied to the retaining stopper pin 4 in the direction resisting the force of the second spring 6.

The first and second pin holding holes 2, 5 communicate with the atmosphere, respectively, through drain channels 7, 8, which functions simultaneously as an oil drain channel and as an air releasing hole.

Figure 2:
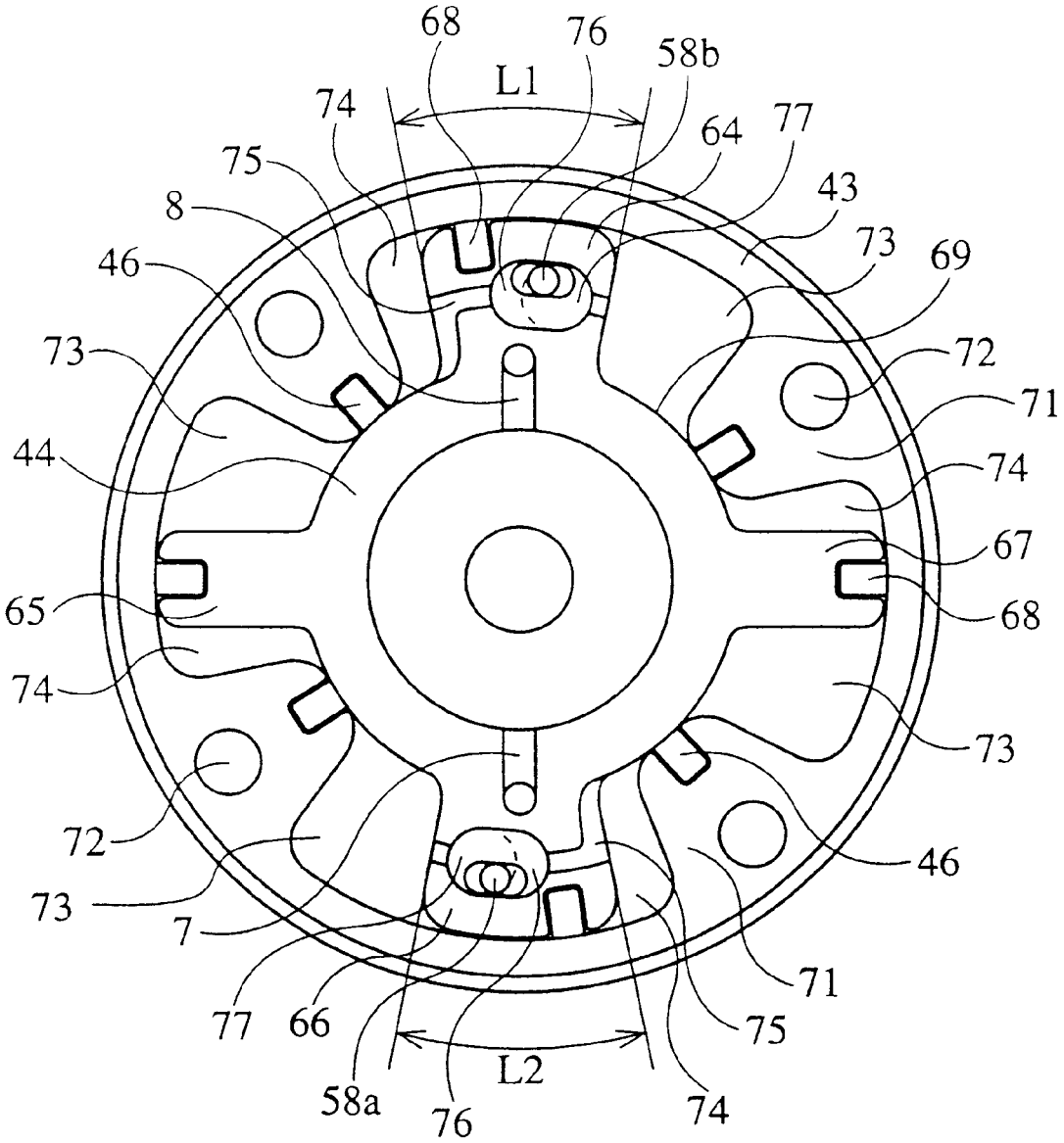
FIG. 2 is a cross sectional view of the vane type hydraulic actuator of FIG. 1, seen from the cover side, in which the cover and the housing are removed.
Figure 3:
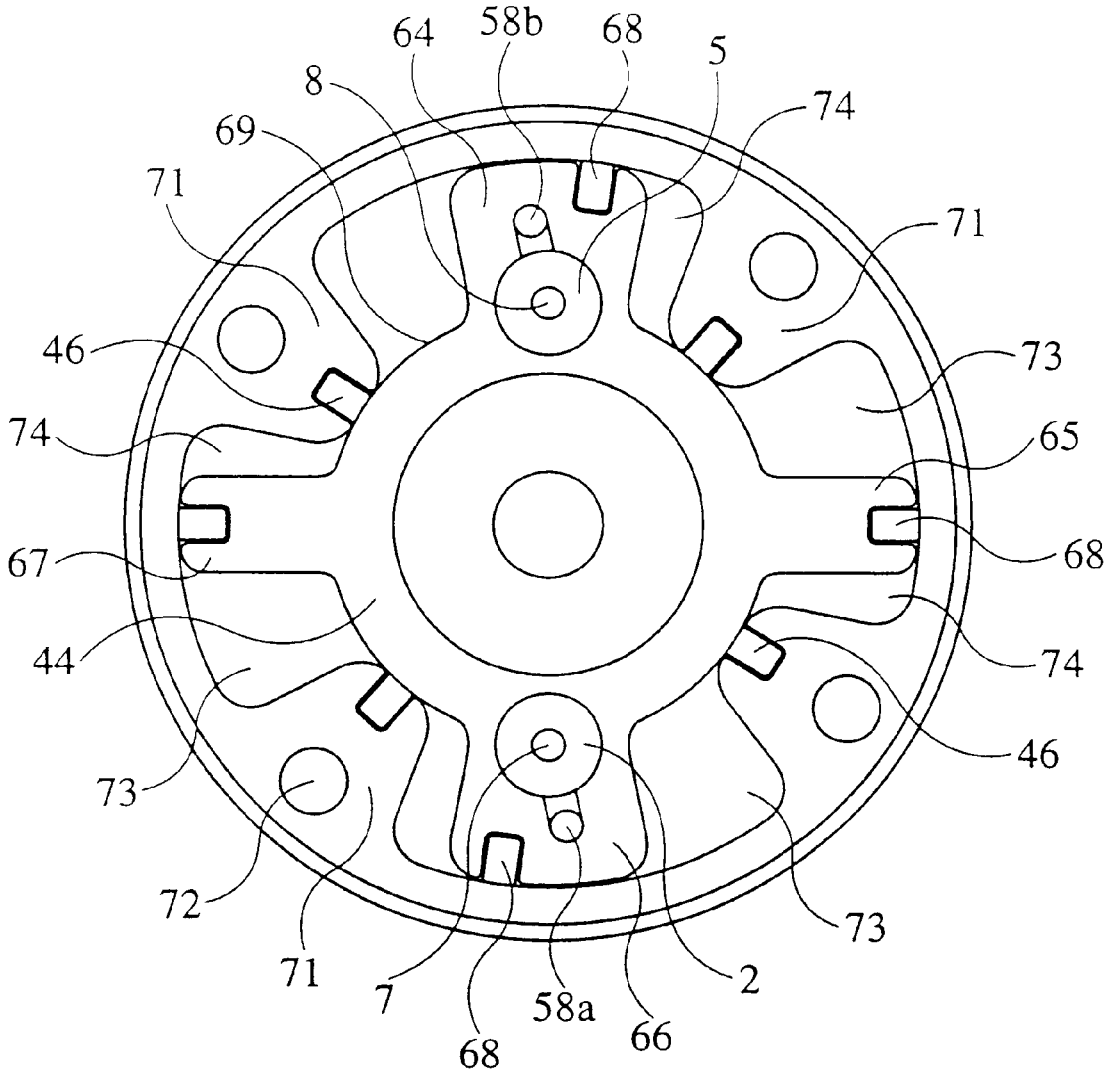
FIG. 3 is a cross sectional view of the vane type hydraulic actuator of FIG. 1, seen from the housing side, in which the cover and the housing are removed.
Figure 4:
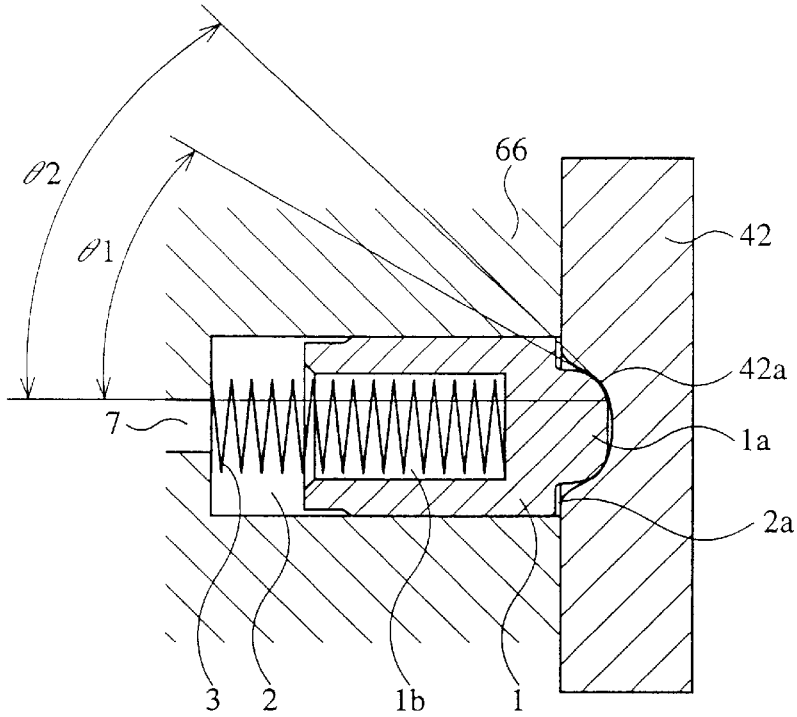
FIG. 4 is a detailed cross sectional view of the guide stopper pin receiving portion shown in FIG. 1.

A first oil channel 58*a* is disposed in the vane 66 which has the guide stopper pin 1. The first oil channel 58*a* connecting the groove 76 and the first gap 2*a* is comprised of a through-hole penetrating the vane 66 in parallel with the axis direction of the rotor. The groove 76 is disposed in the communicating channel 75. The oil pressure chambers for timing retard and timing advance 73, 74 are connected through the groove 76, as shown in FIG. 2. A slide plate 77 for opening and closing the first oil channel 58*a* is disposed in the groove 76 so as to function as a channel switching valve. When an oil pressure from the oil pressure chamber for timing retard is applied to the slide plate 77, the slide plate 77 connects the first oil channel 58*a* to the oil pressure chamber for timing retard 73, and cuts off the channel to the oil pressure chamber for timing advance 74. On the other hand, when an oil pressure from the oil pressure chamber for timing advance 74 is applied to the slide plate 77, he slide plate 77 connects the first oil channel 58*a* to the oil pressure chamber for timing advance 74 and cuts off the oil channel to the oil pressure chamber for timing retard 73.

The first gap 2*a*, the first oil channel 58, the communicating channel 75 and the groove 76 form an oil channel for releasing the locking of the guide stopper pin 1, by delivering oil pressure to release the locking of the guide stopper pin 1. And the slide plate 77 forms an oil channel switching means for connecting the oil channel for releasing the lock of the guide stopper pin to either of the oil pressure chambers for timing retard and timing advance.

A second oil channel 58*b* is disposed in the vane 64, which is found at a symmetrical position to the vane 66 having the first oil channel 58. The vane 64 has a retaining stopper pin 4. The second oil channel 58*b* is comprised of a through-hole penetrating the vane 64, and the groove 76 and the second gap 5*a* is connected through the second oil channel 58*b*.

Also in this oil pressure system for the retaining stopper pin 4, similar to the oil pressure system for the guide stopper pin 1, the second gap 5*a*, second oil channel 58*b*, communicating channel 75 and the groove 76 form a lock releasing oil pressure channel for supplying oil pressure to the retaining stopper pin 4 in the direction to release the locking of the retaining stopper pin 4. And the slide plate 77 functions as an oil channel switching means for connecting the lock releasing oil channel either to the oil pressure chamber for timing retard 73 or to the oil pressure chamber for timing advance 74.

In FIG. 2, the length L1 is the peripheral width of the tip portion of the vane 64 having the retaining stopper pin 4. The length L2 is the peripheral width of the tip portion of the vane 66 having the guide stopper pin 1. The lengths L1 and L2 are designed to be substantially equal.

The function of the first embodiment is explained below.

When first and second bosses 1*a*, 4*a* of the guide stopper pin 1 and the retaining stopper pin 4 are inserted respectively in the first and second engaging recesses 42*a*, 42*b*, so that the case 43 incorporated in the housing 42 is engaging with the rotor 44 so as to rotate together with, as shown in FIG. 1, oil pressure is supplied to the guide stopper pin 1 and the retaining stopper pin 4 from the oil pressure chambers for timing retard 73 or timing advance 74 through the first or second gaps 2*a*, 5*a*. When the oil pressure exceeds the resilient force of the springs 3, 6, the first and second bosses la, 4a of the guide stopper pin 1 and the retaining stopper pin 4 pushed out from the first and second engaging recesses, 42*a*, 42*b*. As a result the locking between the case 43 and the rotor 44 is released, so that they can rotate independently. While the locking is released, the relative position between the case 43 and the rotor 44 can be adjusted so as to optimize the timing of opening and closing of the valves.

Starting from this lock released state, when the oil pressure supplied to the guide stopper pin 1 and the retaining stopper pin 4 is decreased to be lower than the resilient force of the springs 3, 6, the guide.-stopper pin 1 and the retaining stopper pin 4 displace, respectively, to enter into the first and second engaging recesses 42*a*, 42*b*. However, there may be a case that the position of the case 43 and the position of the rotor 44, are offset from a regular engaging position, where the second engaging boss 4*a* can enter into the second engaging recess 42*b*. Namely there is a case that they are not aligned exactly to each other. Even in such a case, the offset can be corrected and the first engaging boss 1*a* can enter smoothly into the first engaging recess 42*a*, because the first engaging boss 1*a* of the guide stopper pin 1 and the corresponding first engaging recess 42*a* are tapered, more specifically, the tapering angle θ 2 of the engaging recess 42*a* is designed smaller than the tapering angle θ 1 of the engaging boss 1*a*. When the offset of the position of the rotor is corrected, the second engaging boss 4*a* of the retaining stopper pin 4 aligns to the second engaging recess 42*b*, then, the retaining stopper pin 4 advances due to the resilient force of the spring 6 so that the engaging boss 4*a* enters into the engaging recess 42*b*. As a result, the rotor 44 is locked to the case 43, and they can rotate synchronously. To sum up, even when the relative position of the case 43 and the rotor 44 is offset from a regular engaging position, the offset can be corrected by the guide stopper pin 1, and the rotor 44 can be locked securely by the retaining stopper pin 4 to the case 43 at the corrected position.

Figure 5:
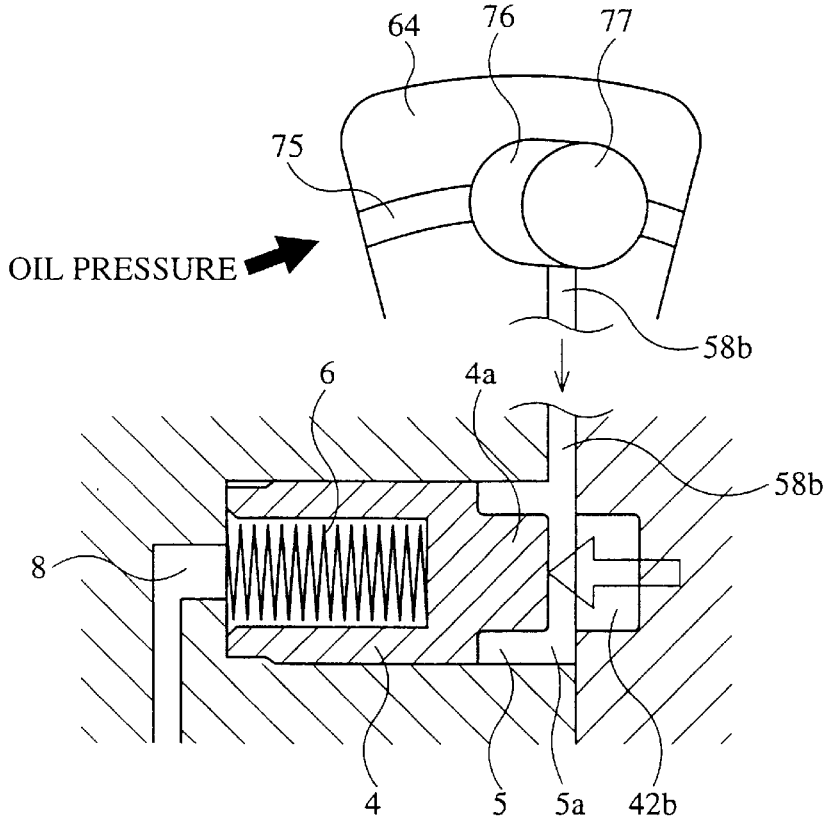
FIG. 5 is a cross sectional view of the retaining stopper pin, showing the movement when the oil pressure in the oil pressure chamber for timing advance is applied.
Figure 6:
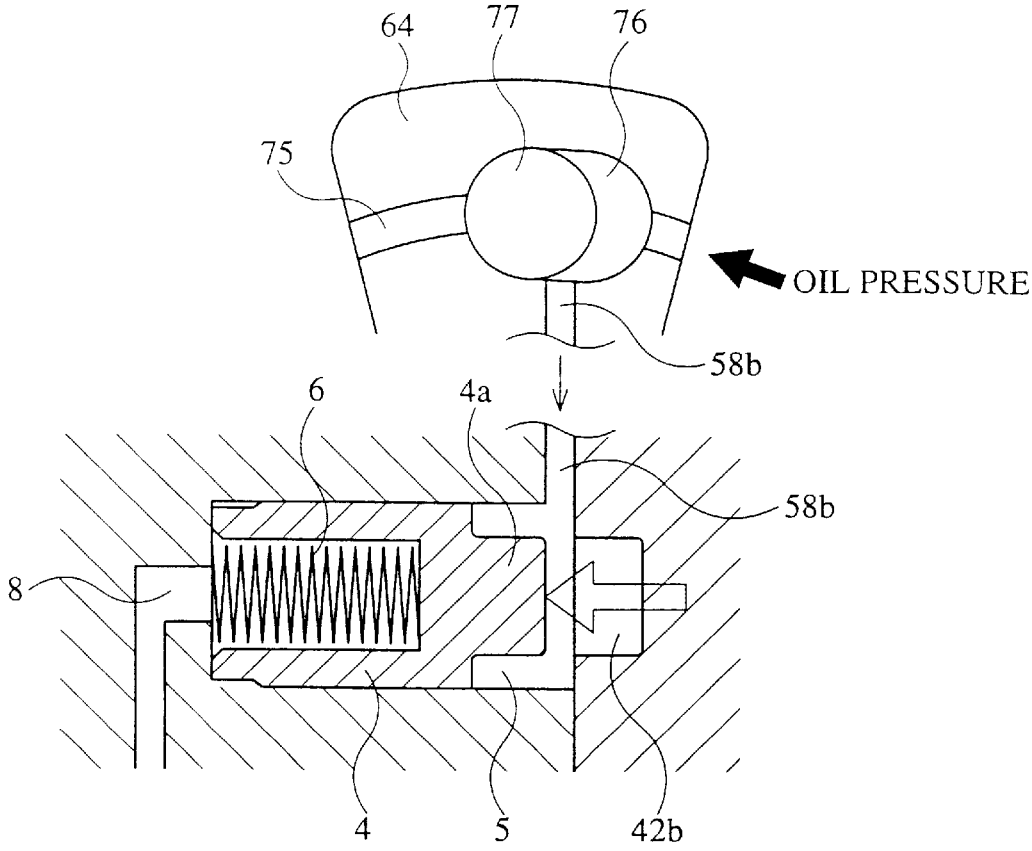
FIG. 6 is a cross sectional view of the retaining stopper pin, showing the movement when the oil pressure in the oil pressure chamber for timing retard is applied.

While the position of the rotor 44 is adjusted either to the direction of the timing retard or the timing advance, the slide plated 77 takes either of the two positions, a position in which the first oil channel 58*a* and the second oil channel 58*b* are connected to the oil pressure chamber for timing advance 74, as shown in FIG. 5 (only the second oil channel 58*b* is shown), or a position in which the first oil channel 58*a* and the second oil channel 58*b* are connected to the oil pressure chamber for timing retard 73, as shown in FIG. 6 (only the second oil channel 58*b* is shown). Therefore, while the position of the rotor 44 is adjusted either to the direction of the timing retard or the timing advance, oil pressure can be applied securely to both of the guide stopper pin 1 and the retaining stopper pin 4 either from the oil pressure chambers for the timing advance 74 or the timing retard 73 so that the both the guide stopper pin 1 and the retaining stopper pin 4 can be displaced smoothly in the lock releasing direction due to oil pressure. The other functions of this vane type hydraulic actuator according to the first embodiment of the present invention are substantially identical to that of the prior art, thus their explanations are omitted.

According to the first embodiment, advantages can be obtained in that, although the structure of the vane type hydraulic actuator is simple, the rotor 44 can be securely retained at a position for timing retard or at a position for timing advance while the engine is stopping so that the timing of opening and closing of the valves can be optimized. Because, after the rotor 44 is guided to a regular engaging position, where the second engaging boss 4*a* of the retaining stopper pin 4 aligns to the second engaging recess 42*b*, the second engaging boss 4*a*, formed as a parallel pin, of the retaining stopper pin 4 is pushed into the second engaging pin 42*b* by the resilient force of the spring 6 so that the rotor 44 engages with the case 2 at the position.

Another advantage is that the engaging position between the first engaging boss 1*a* of the guide stopper pin 1 and the first engaging recess 42*a* and the engaging position between the second engaging boss 4*a* of the retaining stopper pin 4 and the second engaging recess 42*b* can be so designed that the vanes 64–67 of the rotor 44 lock the rotor 44 and the case 43 at an intermediate position apart from the shoes 71 of the case 43, thus, the rotor 44 can be locked securely at an arbitrary timing retard position or at an arbitrary timing advance position. As a result, the timing of the opening and closing timing of the valves can further optimized.

Another advantage is that the first engaging boss 1*a* can enter smoothly into the first engaging recess 42*a*, even when the position of the rotor 44 relative to the case 43 is offset from the regular locking position. Because the tapering angle θ 2 of the second engaging recess 42*a* is larger than the tapering angle θ 1 of the first engaging boss 1*a* of the guide stopper pin 1. The difference between the angles θ 1 and θ 2 is an allowance for the engagement of the rotor 44 and the case 43. Within the allowance, the position of the rotor 44 can be corrected to the regular engaging position, and the rotor 44 can be locked securely by means of the retaining stopper pin 4.

Another advantage is that an unbalanced rotation of the rotor 44 can be avoided. Because the vane 66 having the guide stopper pin 1 and the vane 64 having the retaining stopper pin 4 are disposed symmetrically in respect with the axis of the rotor 44, and the lengths L1, L2 of their tip portions in the peripheral direction are substantially equal.

Another advantage is that, once the first engaging boss 1*a* of the guide stopper pin 1 enters into the first engaging recess 42*a*, disengagement of the first engaging boss 1*a* and the first engaging recess 42*a* due the rotation of the rotor 44 can not occur. Because the resilient force of the spring 3 urging the guide stopper pin 1 is stronger than the resilient force of the spring 3 urging the retaining stopper pin 4. If the resilient force for the guide stopper pin 1 having a tapered engaging boss 1*a* is weak, there is an apprehension that the tapered engaging boss 1*a* will disengage from the first engaging recess 42*a*. In this embodiment, such an apprehension is removed, and the resilient force of the spring 3 for the retaining stopper pin 4 can be designed to be weak.

Embodiment 2

In the first embodiment, the peripheral lengths L1, L2 of the tip portion of the vane 66 having the guide stopper pin 1 and the tip portion of the vane 64 having the retaining stopper pin 4 are designed to be substantially equal, from a view point of the rotation balance of the rotor 44. In the second embodiment, a weight balancing recess (not shown) is disposed in either of the vanes 66, 64, for maintaining the rotation balance of the rotor 44. The other structure, function, and advantage are identical to those of the first embodiment.

Embodiment 3

Figure 8:
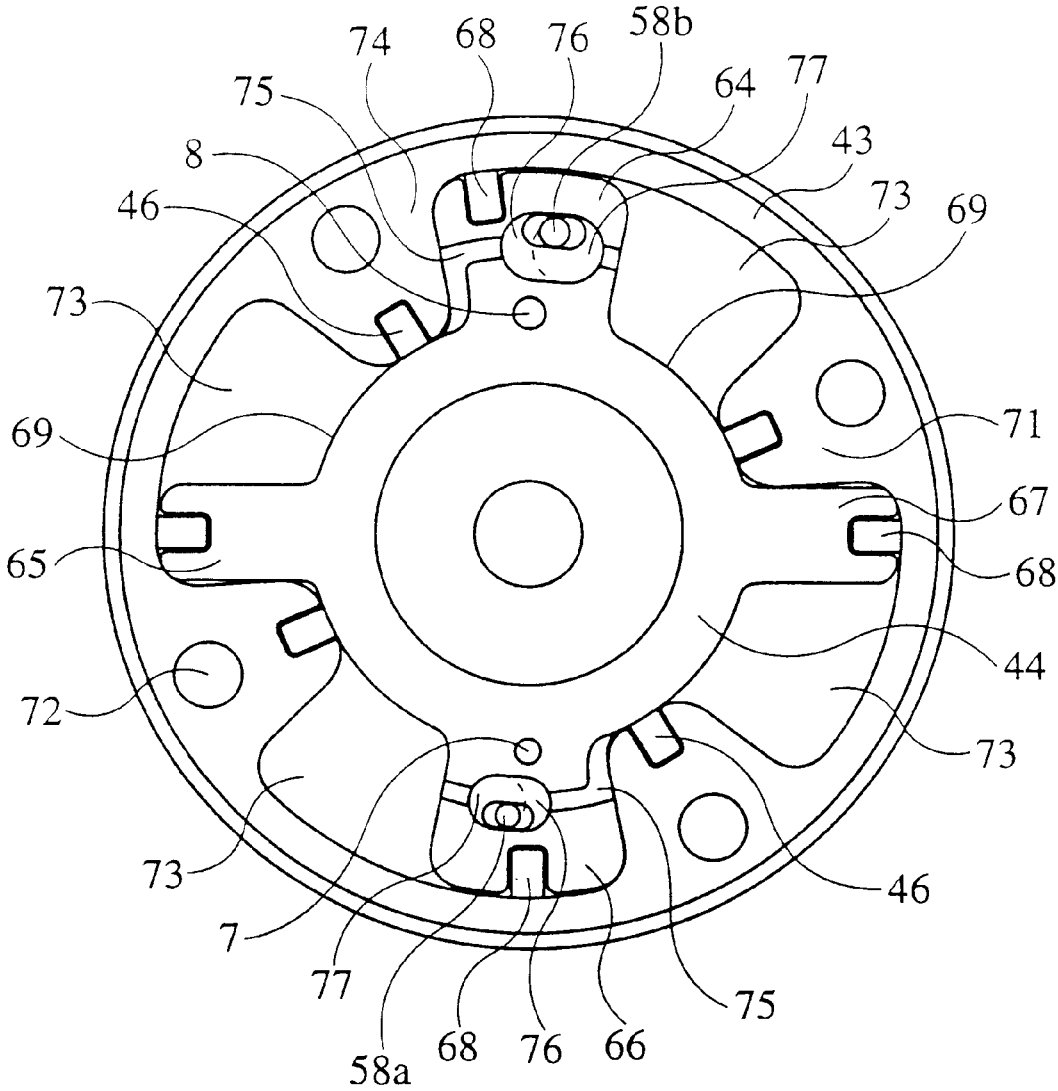
FIG. 8 is a cross sectional view of the vane type hydraulic actuator of FIG. 7, seen from the cover side, when the cover is removed.
Figure 9:
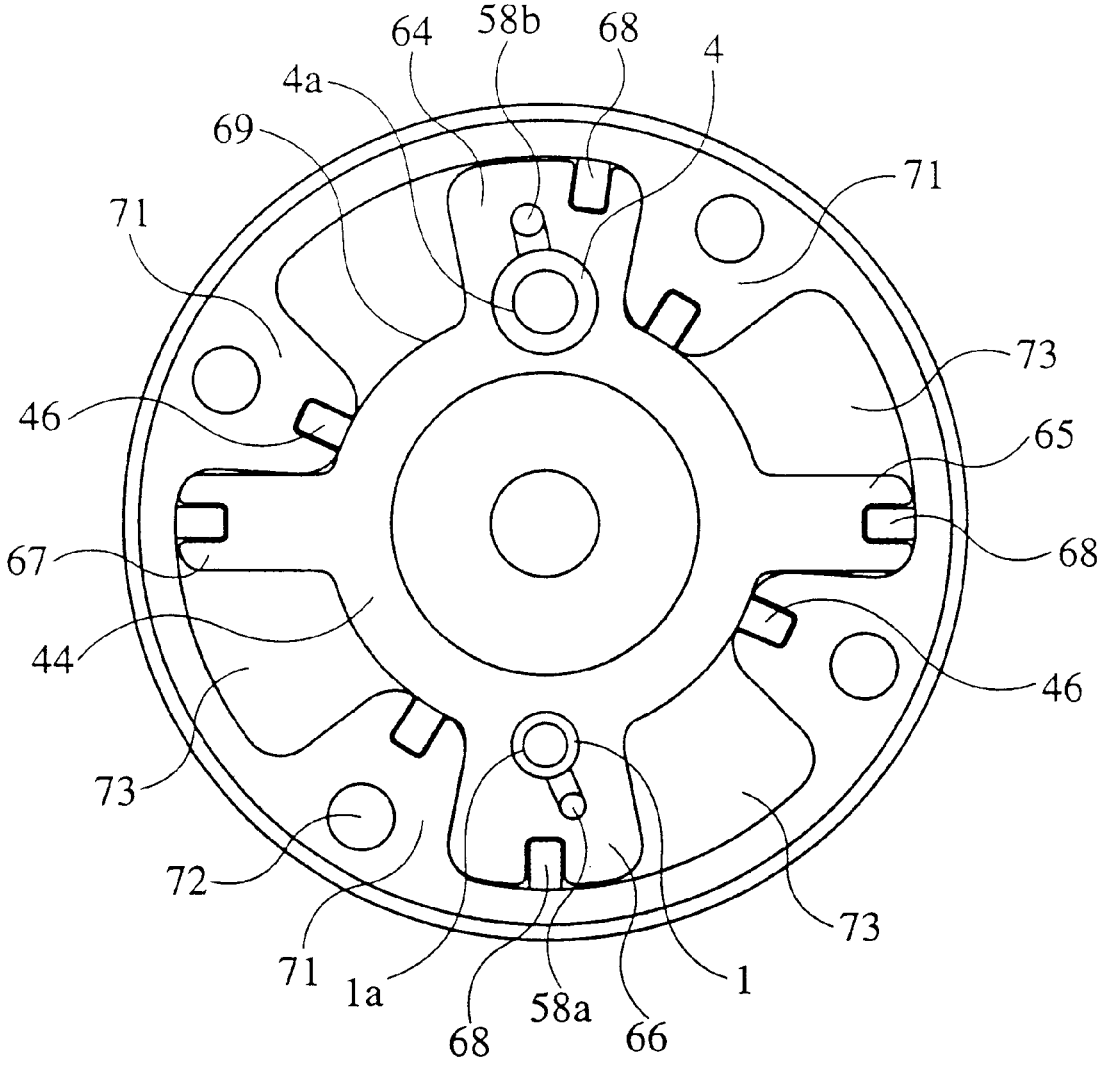
FIG. 9 is a cross sectional view of the vane type hydraulic actuator of FIG. 7, seen from the housing side, when the housing is removed.

A vane type hydraulic actuator according to the third embodiment of the present invention is explained below, referring to FIGS. 7 to 9.

Figure 7:
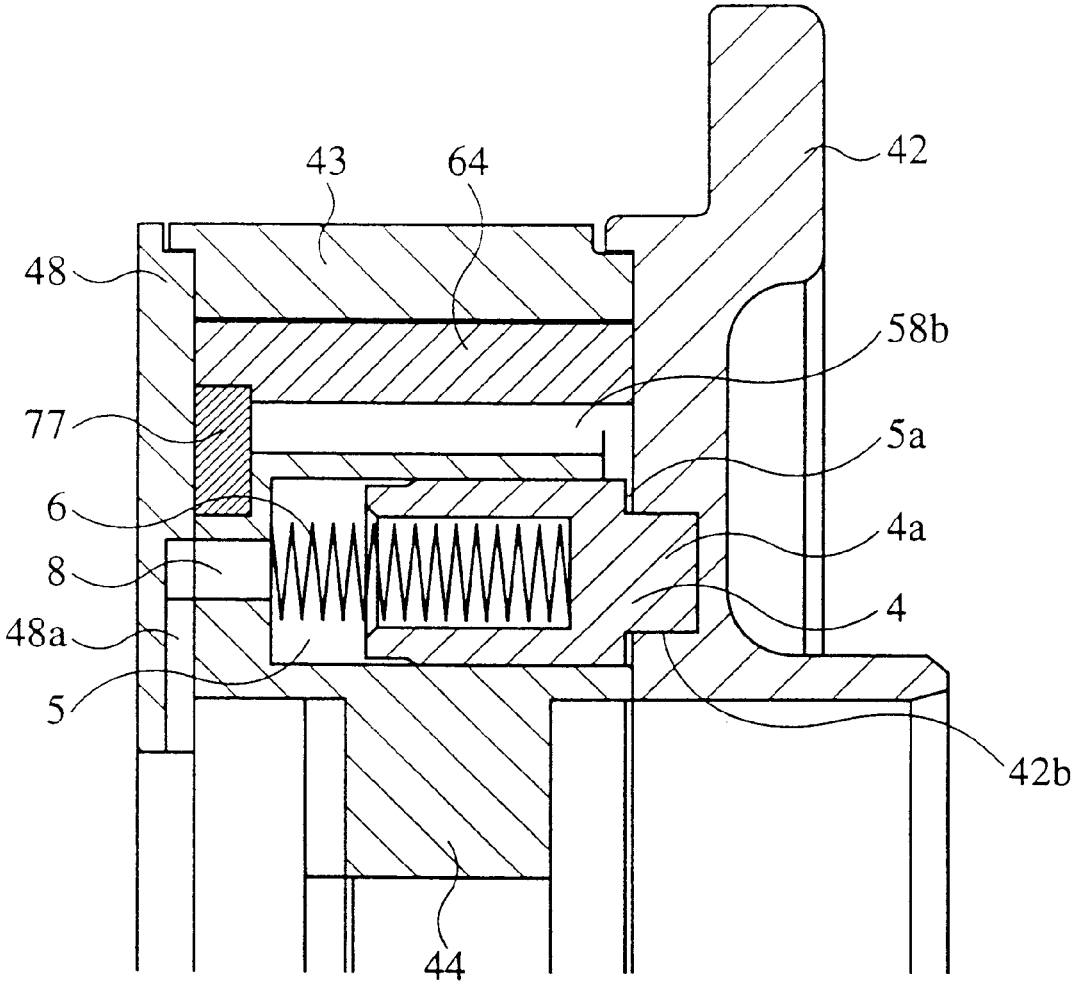
FIG. 7 is a cross sectional view of a main part of the vane type hydraulic actuator according to third embodiment of the present invention.

Reference numeral 48*a* in FIG. 7 denotes a fluid channel disposed on the contacting surface of the cover 48, which rotates together with the case 43. The rotor 44 contacts with this contacting surface and slides along it. Only when the retaining second stopper pin 4 is engaging with the second engaging recess 42*b* and the rotor 44 is retained, a fluid channel 8 behind the rotor 44 communicates with the fluid channel 48*a* so that the space behind the rotor 4 including the second pin holding hole 5 is opened to the atmosphere.

When the second engaging boss 4*a* of the retaining stopper pin 4 is disengaged from the second engaging recess 42*b* and the retaining of the rotor 44 is released, the cover 48 integrating case 43 rotates relatively to the rotor 44, therefore the position of the fluid channel 48 in the cover 48 is offset from the fluid channel 8 in the rotor 44, as a result, the fluid channel 8 in the rotor 44 is cut off by the cover 48.

In addition to the fluid channel 48*a*, another fluid channel (not shown) is disposed in the cover 48, which is connected to a similar fluid channel 7 for the system of the guide stopper pin 1. The structure and the function of the fluid channel is identical to the fluid channel 48*a*, thus their explanations are omitted.

In this embodiment, the cross sectional area of the guide stopper pin 1 is not always equal to that of the retaining stopper pin 4. For example, the cross sectional area of the guide stopper pin 1, shown in FIG. 9, is smaller compared to that of the retaining stopper pin 4. Otherwise, the cross sectional area of the guide stopper pin 1 can be larger than that of the retaining stopper pin 4.

The other features of the third embodiment of the present invention are identical to those of the first embodiment. Thus the components equivalent or corresponding to those in the first embodiment are referred to the same reference numerals, and their explanations are omitted.

According to the third embodiment, advantages can be obtained in that the retaining stopper pin 4 and the guide stopper pin 1 can be smoothly displaced from a position retaining the rotor 44 to a retaining releasing position. Because a fluid channel 48*a* for the system of the retaining stopper pin 4 and a fluid channel (not shown) for the system of the guide stopper pin 1 are disposed on the contacting surface of the cover 48, where the rotor 44 contacts and slides along it, so that, only when the rotor 44 is locked, the fluid channels can, respectively, communicate with the fluid channel 8 in the system for the retaining stopper pin 4 and the fluid channel (not shown) in the system for the guide stopper pin 1.

Another advantage is that miss-assembling of the guide stopper pin 1 and the retaining stopper pin 4 in the fabrication process can be avoided, when the cross-sectional area of the guide stopper pin 1 and that of the retaining stopper pin 4 are different. For example, miss-assembling of the retaining stopper pin 4, instead of the guide stopper pin 1, into the first pin holding hole 2 corresponding to tapered first engaging recess 42*a* can be prevented. As a result, the efficiency of the assembling of the components of the apparatus can be improved.

Embodiment 4

Fourth embodiment of the present invention is explained below, referring to FIG. 10.

Figure 10:
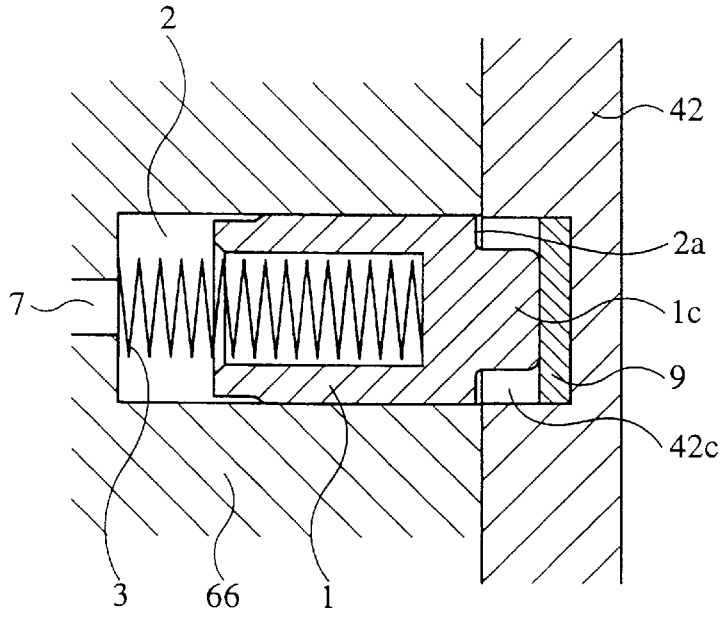
FIG. 10 is a cross sectional view of a vane type hydraulic actuator according to fourth embodiment of the present invention.

Reference numeral 1*c* in FIG. 10 denotes a first engaging boss disposed at an end in the longitudinal direction of the guide stopper pin 1. The first engaging boss 1*c* is formed as a parallel pin. The first engaging boss 1*c* engages into a first engaging recess 42*c* disposed on the contacting surface of the housing 42 having a diameter larger than that of the first engaging boss 1*c*. The rotor 44 contacts with this contacting surface and slides on it. When the first engaging boss 1*c* enters into the first engaging recess 42*c*, the first engaging boss 1*c* contacts with a friction increasing member 9 disposed in the base region of the first engaging recess 42*c*. That is to say, in the fourth embodiment, the first engaging boss disposed at an end of the guide stopper pin 1 is formed as a parallel pin; the diameter of the first engaging recess 42*c*, into which the first engaging boss 1 enters, is larger than that of the first engaging boss 1*c*; a friction increasing member 9 is disposed in the base region of the first engaging recess 42*c*; and the tip portion of the first engaging boss 1*c* contacts with the friction increasing member 9. The other features of the fourth embodiment is identical to those of the first embodiment of the present invention. Thus components identical or equivalent to those in the first embodiment are referred to the same reference numeral, and their explanation Is omitted.

The function of the vane type hydraulic actuator according to the fourth embodiment is explained below.

When the guide stopper pin 1 is urged by the resilient force of the spring 3 so that the first engaging boss 1*c* enters into the first engaging recess 42*c*, and the tip of the first engaging boss 1*c* contacts with the friction increasing member 9, the relative velocity between the rotor 4 and the housing 42 decreases corresponding to the:increased friction resistance of the first engaging boss 1*c*. As a result, the movement of the retaining stopper pin 4 to lock the rotor 4 is rendered smooth.

The features of the fourth embodiment is found In that the first engaging boss 1*c* of the guide stopper pin 1 is formed as a parallel pin; the diameter of the first engaging recess 42*c* is larger than the diameter of the first engaging boss 1*c*, which-enters into the first engaging recess 42*c*; a friction increasing member 9 is disposed in the base portion of the first engaging recess 42*c*; and the first engaging boss 1*c* contacts with the friction increasing member 9. Once the first engaging boss 1*c* of the guide stopper pin 1 contacts with the friction increasing member 9 for locking the rotor 44, the relative velocity between the rotor 4 and the housing 42 decreases due to the increased friction resistance.

Consequently, according to these features of the fourth embodiment of the present invention, advantages can be obtained in that, though the first engaging boss 1*c* of the guide stopper pin 1 is formed as a parallel pin, the positioning of the rotor 44 to the locking position by means of the retaining stopper pin 4 is easy, and the retaining stopper pin 4 can move smoothly and securely in the engaging direction to lock the rotation of the rotor 44.

Embodiment 5

Figure 11:
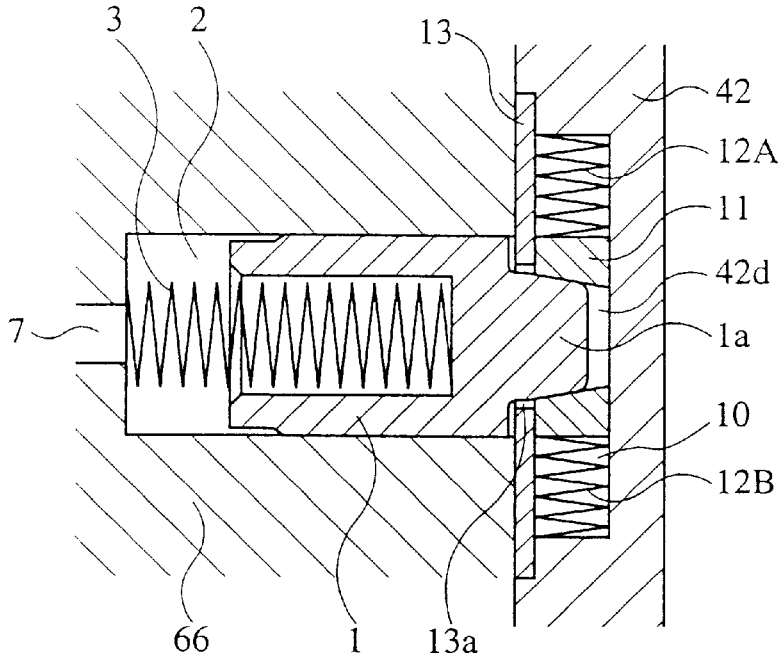
FIG. 11 is a cross sectional view of the main portion of the vane type hydraulic actuator according to the fifth embodiment of the present invention.
Figure 12:
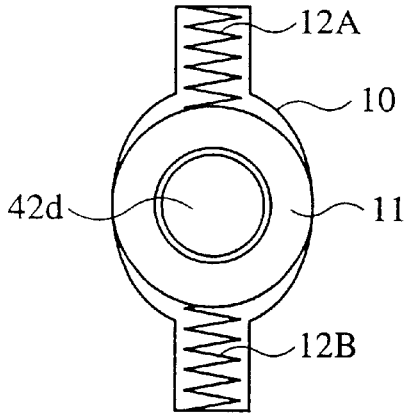
FIG. 12 is a front view of the pin holder portion in FIG. 11.

The vane type hydraulic actuator according the fifth embodiment of the present invention is explained below, referring to FIGS. 11 and 12.

A pin holder 11 is installed in a recessed groove 10 disposed on the contacting surface of the housing 42, which rotates together with the case 43. The rotor 44 contacts with the contacting surface and slides along it. The pin holder 11 has a second engaging recess portion 42*d*, which is tapered so that the engaging boss 1*a* of the guide stopper pin 1 can enter in it and disengage from it. The pin holder 11 can slide in the recessed groove 10.

A pair of balance springs 12A, 12B are disposed in the recessed groove 10 at both sides of the pin holder 11. The balance springs functions as a resilient holding means for holding the pin holder 11 so that the pin holder 11 can move in the radial direction of the rotor 44. The recessed groove 10 is covered by a cover 13, which has an opening 13*a* communicating with the second engaging recess portion 42*d*. The diameter of the opening 13*a* is larger than the diameter of the second engaging recess portion 42*d* at the larger diameter side. The inner surface of the cover 13 is coplanar with the inner surface of the housing 42 (the contacting surface of the rotor 44). Otherwise, the pair of the balance springs 12A, 12B can be arranged so that the pin holder 11 can move in the rotation direction of the rotor 44. The other structure and function of the fifth embodiment are identical to those of the first embodiment.

The function of the fifth embodiment is explained below.

When the rotor 44 is locked, the guide stopper pin 1 is pushed by the resilient spring 3 so that the first engaging boss 1*a* of the guide stopper pin 1 enters into the first engaging recess 42*d* through the opening 13*a* and the guide stopper pin 1 is temporarily locked to the housing 42, in a similar way as in the first embodiment.

Even when the first engaging boss 1*a* of the guide stopper pin 1 is not positioned just in front of the first engaging recess 42*d* in the pin holder 11 and they are not aligned to each other, the first engaging boss 1*a* can enter easily into the first engaging recess 42*d* and can be held at a center portion of the balance springs 12A, 12B, that is an equilibrium position of the resilient force of the balance springs. After the temporal locking, the relative velocity between the rotor 44 and the housing 42 decreases so that the retaining stopper pin 4 can move smoothly and securely in the direction to lock the rotor 44.

As explained above, the features of the fifth embodiment are such that the first engaging boss 1*a* of the guide stopper pin 1 is tapered; a pin holder 11 having a tapered engaging recess 42*d*, in which the first engaging boss 1*a* can engage, is installed in a groove 10 disposed in the housing 42; the pin holder 11 is resiliently held by a pair of balance springs 12A, 12B. Thus, the first engaging boss 1*a* of the guide stopper pin 1 can easily enter into the first engaging recess 42*d* in the pin holder 11 so that the rotor 44 can be smoothly locked temporarily, and the relative velocity between the rotor 44 and the housing 42 decreases because of the temporal locking of the rotor 44. Consequently, advantages can be obtained in that the retaining stopper pin 4 can be displaced smoothly and securely in the direction to lock the rotor 44, and that a large allowance in assembling of the pin holder 11 into the housing 42 is permissible, because the pin holder 11 is held by a pair of balance springs 12A, 12B.

Embodiment 6

Figure 13:
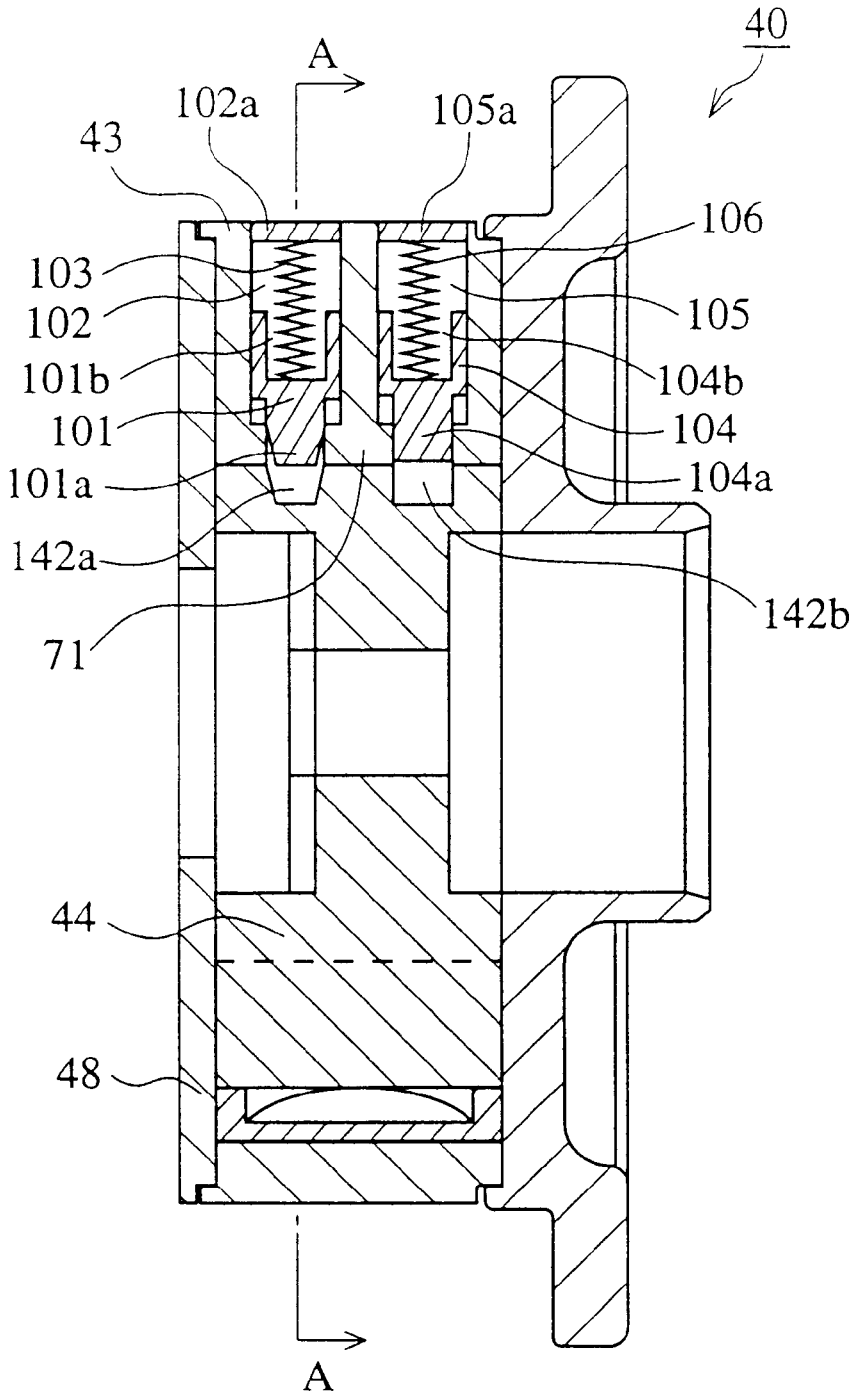
FIG. 13 is a cross-sectional view of the vane type hydraulic actuator according to the sixth embodiment of the present invention, showing along the axis of the rotor.
Figure 14:
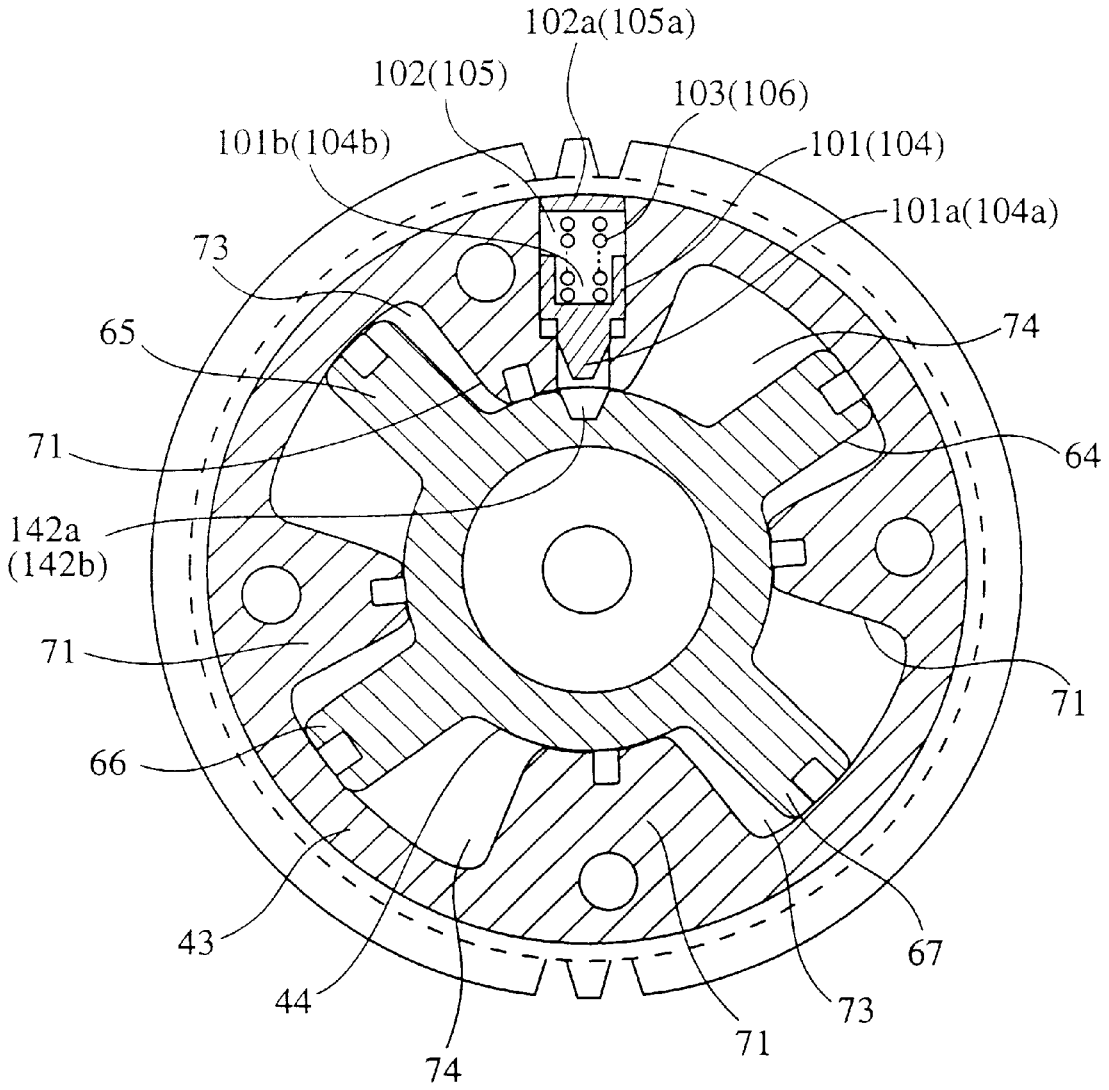
FIG. 14 is a cross-sectional view of FIG. 13, showing along the line A—A in FIG. 13.
Figure 15:
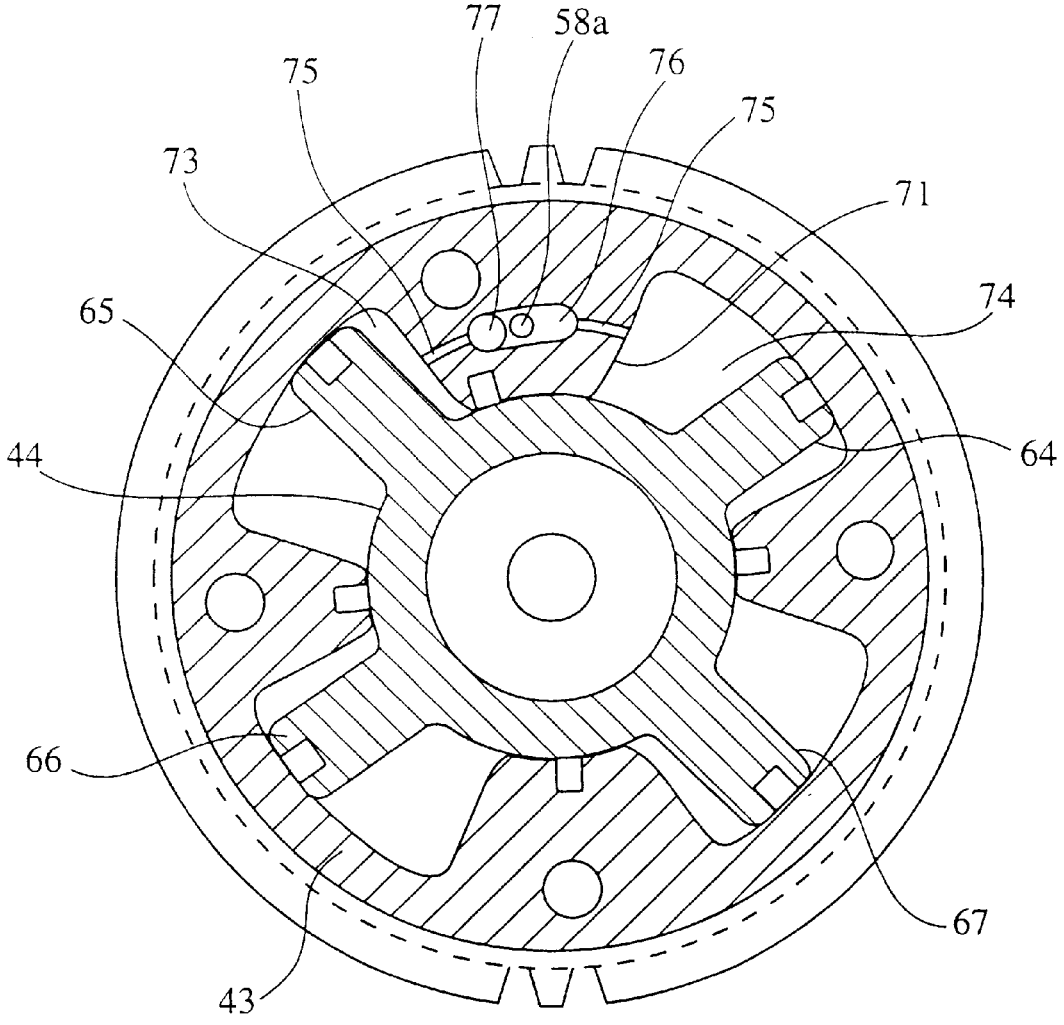
FIG. 15 is a radial cross sectional view of the actuator, showing the oil channel switching system for driving the guide stopper pin and the retaining guide pin in FIGS. 13, 14.

The vane type hydraulic actuator according to the sixth embodiment is explained, referring to FIGS. 13 to 15. Components identical or corresponding to those explained referring to FIGS. 1–9 are referred to the same reference numerals, and their explanations are omitted.

A first pin holding hole 102 and a second pin holding hole 105 penetrate a shoe 71 of the case 43 in the radial direction. The first and second holding holes 102, 105 are arranged side by side in the direction of the axis of the rotor 44. There is a shoulder portion in each of the first and second pin holding holes 102, 105, more specifically, the inner diameter of each of the first and second pin holding holes 102, 105 is small at the radially inner portion.

The first pin holding hole 102 receives a guide stopper pin 101, which can slide in the radial direction in the hole 102. The guide stopper pin has a first engaging boss 101*a* formed as a tapered pin at its radially inner end portion and a spring holding hole 101b which has an opening at its radially outer end. The guide stopper pin 101 functions as a guide locking means for securely guiding the rotor 44 to a predetermined position to engage with the housing. The guide stopper pin 101 is pushed towards the rotor 44 by a first spring 103. The first spring 103 is held by a plug 102*a*, which is plugged into the radially outer opening of the first pin holding hole 102.

A first engaging recess 142*a* is disposed in the hub portion of the rotor 44, which contacts with the shoe 71, having the first pin holding hole 102, and slides along it. The first engaging recess 142*a* is tapered so that the inner diameter increases gradually outwardly. Thus the first engaging boss 101*a* of the guide stopper pin 101 can enter into the first engaging recess 142*a* and exit from there. When the first engaging boss 101*a* enters in it, the position of the rotor 44 in respect with the case 43 can be corrected, the correction facilitates the engagement of the retaining locking means, as will be explained below.

The second pin holding hole 105A receives a retaining stopper pin 104, which can slide in the radial direction of the case 43. The retaining stopper pin has a second engaging boss 104*a*, formed as a parallel pin with small diameter, in its radially inner portion, and a second spring holding hole 104*b*, which has an opening at its radially outer end portion. The retaining stopper pin 104 functions as a retaining locking means for retaining securely the rotor 44 at a predetermined position. The retaining stopper pin 104 is pushed towards the rotor 44 by a second spring 106. The outer opening of the second spring holding hole 104*b* is plugged by a plug 105*a*, which holds the second spring 106.

A second engaging recess 142*b* is disposed in the hub portion of the rotor 44, with which the shoe 71 having the retaining stopper pin 104 contacts. The second engaging recess 142*b* is arranged adjacently to the first engaging recess 142*a*, which belongs to the system for the guide stopper pin 101, and is formed as a cylindrical hole matched with the second engaging boss 104*a* so that the second engaging boss 104*a* of the retaining stopper pin 104 can enter and exit from it. Preferably, the resilient force of the first spring 103 for the guide stopper pin 101 is designed to be stronger than that of the second spring 106 for the retaining stopper pin 104.

In the first and second embodiments, each of the vane 66 having the guide stopper pin 1 and the vane 64 having the retaining stopper pin 4 has an oil channel for releasing the locking (oil channel 58*a*, 58*b*, communicating oil channel 75, and groove), and an oil channel switching means (slide plate 77). On the other hand, in the sixth embodiment, the guide stopper pin 101 and the retaining stopper pin 104 have a common lock releasing oil pressure channel (oil channel 58*a*, communicating channel 75, and groove 76) and an oil channel switching means (slide plate 77) on a shoe 71 projecting towards the rotor shaft. And the guide stopper pin 101 and the retaining stopper pin 104 are simultaneously activated. The function of these lock releasing oil pressure channel and the oil channel switching means are substantially identical to those in the first embodiment. Thus their explanation is omitted.

By the way, the oil channel 58*a* of the lock releasing oil channel supplies oil pressure, which is delivered either from the oil chambers for timing retard 73 and the for timing advance 74, to the guide stopper pin 101 and the retaining stopper pin 104. The oil pressure urges the guide stopper pin 101 and the retaining stopper pin 104 in the direction resisting the resilient force of the first and second springs 103, 106. Of course, also in the sixth embodiment, it is possible to dispose two sets of the lock releasing oil pressure channel and the oil switching means for independently activating the guide stopper pin 101 and the retaining stopper pin 104. In such a structure, it is preferable to arrange a set of the lock releasing oil pressure channel and the oil switching means on each inner and outer end surfaces of the shoe 71.

The function of the vane type hydraulic actuator according to the sixth embodiment of the present invention is explained below.

When the engine is running, the case 43 and the rotor 44 have to rotate independently to each other. In this state, the oil pressure urging the guide stopper pin 101 and the retaining stopper pin 104 is set larger than the resilient force of the first and second spring 103, 106, so that the first and second engaging boss 101*a*, 104*a* of the guide stopper pin 101 and the retaining stopper pin 104 are pushed out from the first and second engaging recesses 142*a*, 142*b*. As a result, the locking of the rotor is released in this state.

Starting from this locking released state, when the oil pressure urging the guide stopper pin 101 and the retaining stopper pin 104 decreases to be lower than the resilient force of the first and second springs 103 and 106, if, in this moment, the first engaging boss 101*a* of the guide stopper pin 101 and the second engaging boss 104*a* of the retaining stopper pin 104 are positioned exactly aligned to the corresponding first and second engaging recesses 142*a*, 142*b* the first and second engaging bosses 101*a*, 104*a* of the guide stopper pin 101 and the retaining stopper pin 104 will enter into the first and second engaging recess 142*a*, 142*b* due the resilient force of the first and second spring 103, 106, so that the case 43 and the rotor 44 are locked to each other.

However, when the oil pressure urging the guide stopper pin 101 and the retaining stopper pin 104 decreased to be lower than the resilient force of the first and second springs 103, 106, the first engaging boss 101*a* of the guide stopper pin 101 and the second engaging boss 104*a* of the retaining stopper pin 104 are not always positioned exactly aligned to the corresponding first and second engaging recesses 142*a*, 142*b*, namely they can be offset a little from a regular engaging position.

When the offset is within the difference between the diameter of the smaller diameter side tip portion of the first engaging boss 10*a* of the guide stopper pin 101, which is formed as a tapered pin, and the diameter of the opening of the tapered first engaging recess 142*a* at the largest end, the first engaging boss 101*a* can be pushed into the first engaging recess 142*a* by the resilient force of the first spring 103 urging the guide stopper pin 101. As a result, the offset can be corrected. And the second engaging boss 104*a*, which is formed as a cylindrical pin, of the retaining stopper pin 104 and the cylindrically formed second engaging recess 142*b* align to each other, then the cylindrically formed second engaging boss 104*a* enters into the cylindrically formed second engaging recess 142*b*, due to the resilient force of the second spring 106 urging the retaining stopper pin 104. Finally, the rotor 44 can be locked to the case 43.

The resilient force of the first spring 103 of the guide stopper pin 104 can be designed to be larger than that of the retaining stopper pin 104. In such a case, when the oil pressure, which urges commonly the guide stopper pin 101 and the retaining stopper pin 104, is decreased to be lower than the resilient force of the first and second springs 103, 106, even when the first and second engaging bosses 101*a*, 104*a* and the first and second engaging recesses 142*a*, 142*b* are not aligned, the first engaging boss 101*a* of the guide stopper pin 101 enters into the first engaging recess 142*a*, because the resilient force of the first spring 103 of the guide stopper pin 101 is larger than that of the second spring 106 of the retaining stopper pin 104. Then the second engaging boss 104*a* of the retaining stopper pin 104 and the second engaging recess 142*b* align to each other, and the second engaging boss 104*a* can smoothly enter into the second engaging recess 142*a*.

According to the sixth embodiment of the present invention, advantages can be obtained in that the efficiency of the assembling in the production process of the vane type hydraulic actuator is improved, because the guide stopper pin 101 and the retaining stopper pin 104 are disposed on the shoe 71 so as to be adjacent to each other in the direction of the axis of the rotor 44. And even when the position of the second engaging boss 104*a* of the retaining stopper pin 104 is offset form the position of the second engaging recess 142*b*, the first engaging boss 101*a* of the guide stopper pin 101 can enter smoothly into the first engaging recess 142*a*, because the first engaging boss 101*a* of the guide stopper pin is tapered and the first engaging recess 142*a* is tapered so as to allow to receive the first engaging boss 101*a*, so that the offset of the position of the second engaging boss can be corrected when the first engaging boss 101*a* enters into the first engaging recess 142*a*. As a result, the second engaging boss 104*a* of the retaining stopper pin 104 can enter smoothly into the second engaging recess 142*b*, Consequently, the rotor 44 can be locked securely at a predetermined position. Furthermore, the preciseness of the correction of the offset can be improved, because the offset of the retaining stopper pin 104 is corrected by the guide stopper pin 101 disposed at a position very close to the retaining stopper pin 104.

In the aforementioned example of the sixth embodiment, the guide stopper pin 101 and the retaining stopper pin 104 are disposed on a shoe 71 of the case 43 so as to be arranged side by side in the direction of the axis of the rotor, and is possible to slide in the radial direction of the rotor. However, they can be disposed in one of the vanes 64–67 of the rotor 44 so as to be arranged side by side in the direction of the axis of the rotor 44 and be possible to slide in the radial direction. In such a case, similar advantages such as obtained in the explained example of the sixth embodiment can be obtained, by disposing the first and second engaging recesses 142*a*, 142*b* on the inner surface of the case 43, where the vane having the guide stopper pin 101 and the retaining stopper pin 104 contact and slide along it.

Furthermore, also in the sixth embodiment, the guide stopper pin 101 as well as the first engaging recess 142*a* and that of the retaining stopper pin 104 as well as the second engaging recess 142*b* can have different cross sectional areas. The advantages derived from such a structure are identical to that of the third embodiment.

Embodiment 7

Figure 16:
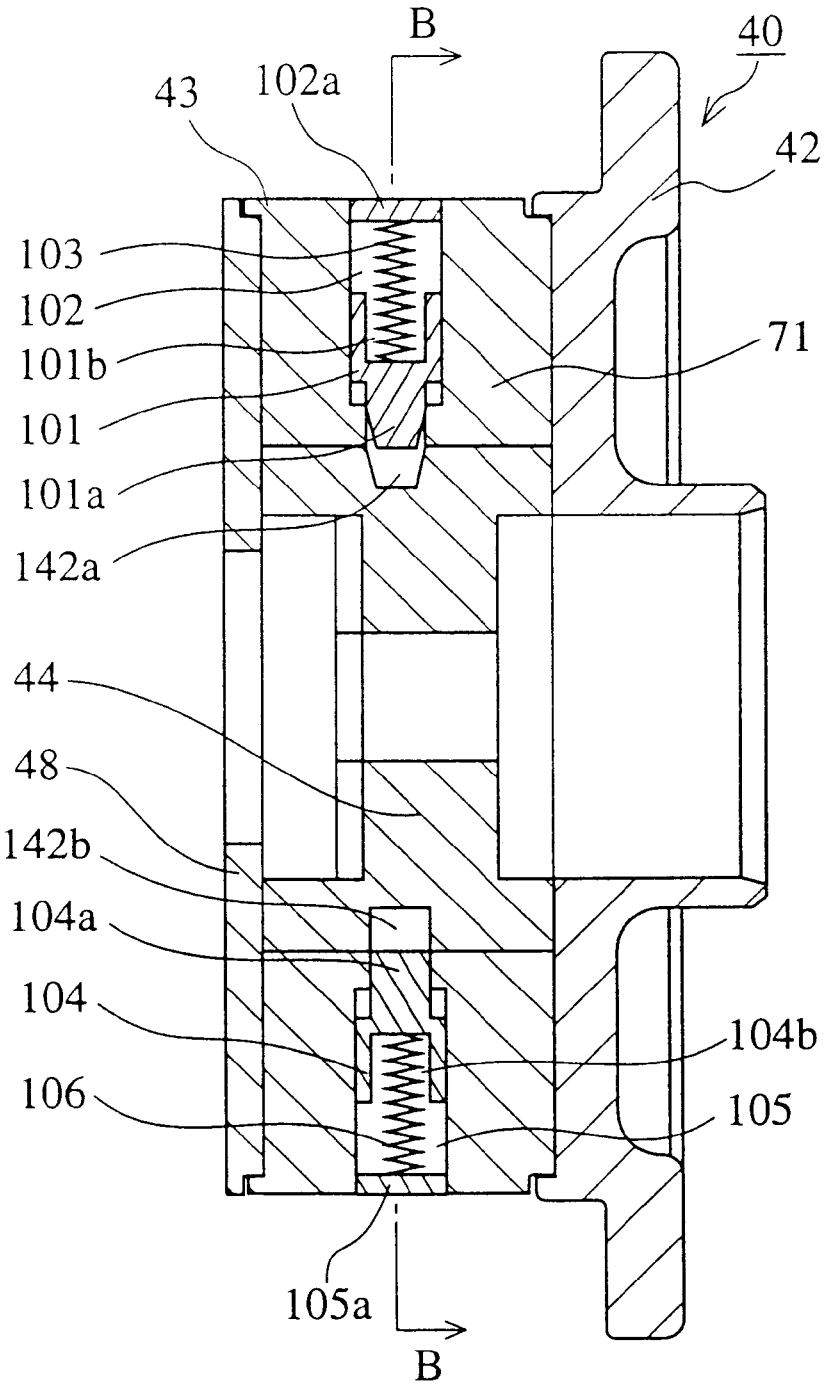
FIG. 16 is a cross sectional view of a vane type hydraulic actuator according to the seventh embodiment of the present invention.
Figure 17:
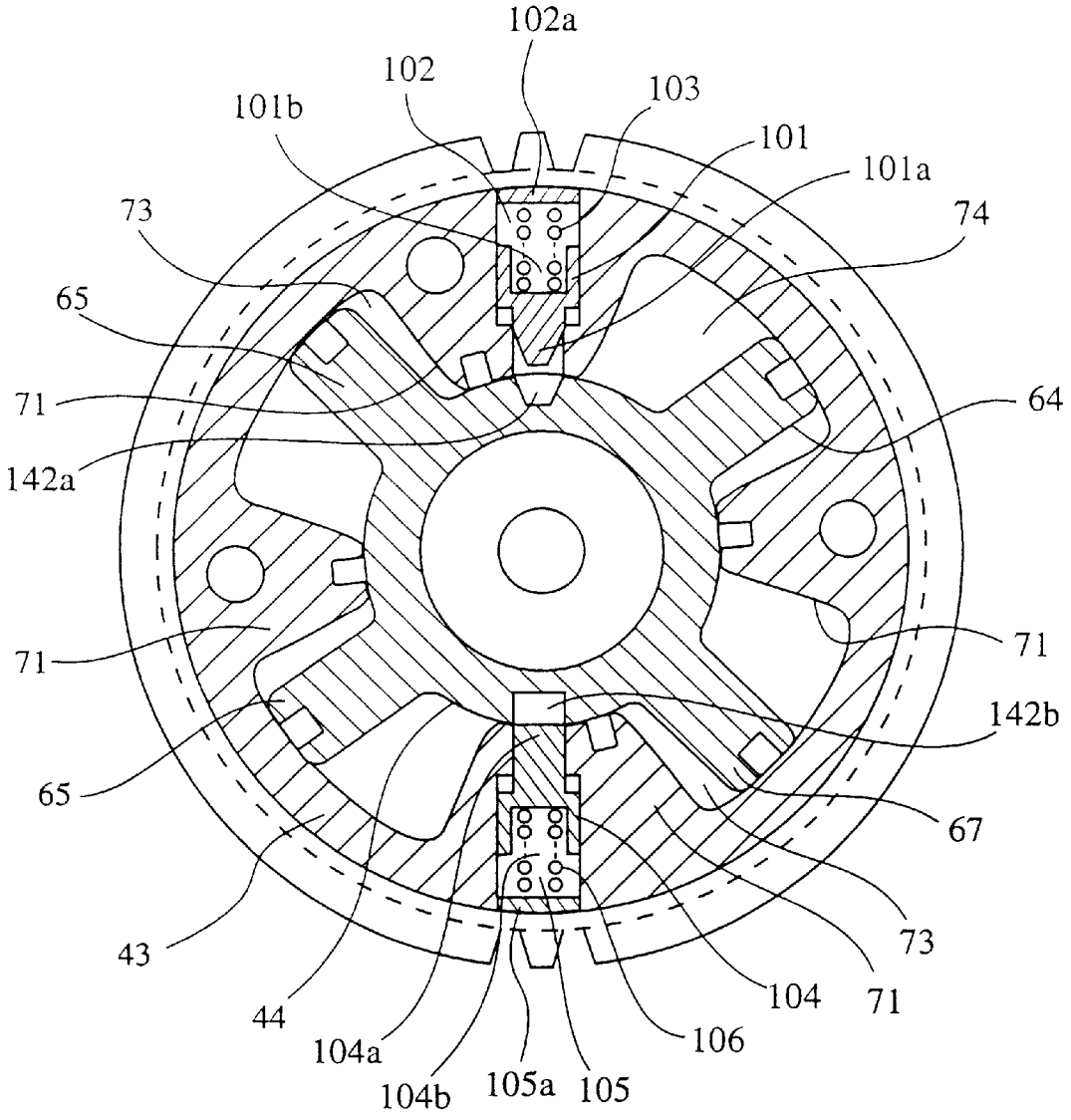
FIG. 17 is a cross sectional view of FIG. 16, showing along the line B—B.
Figure 18:
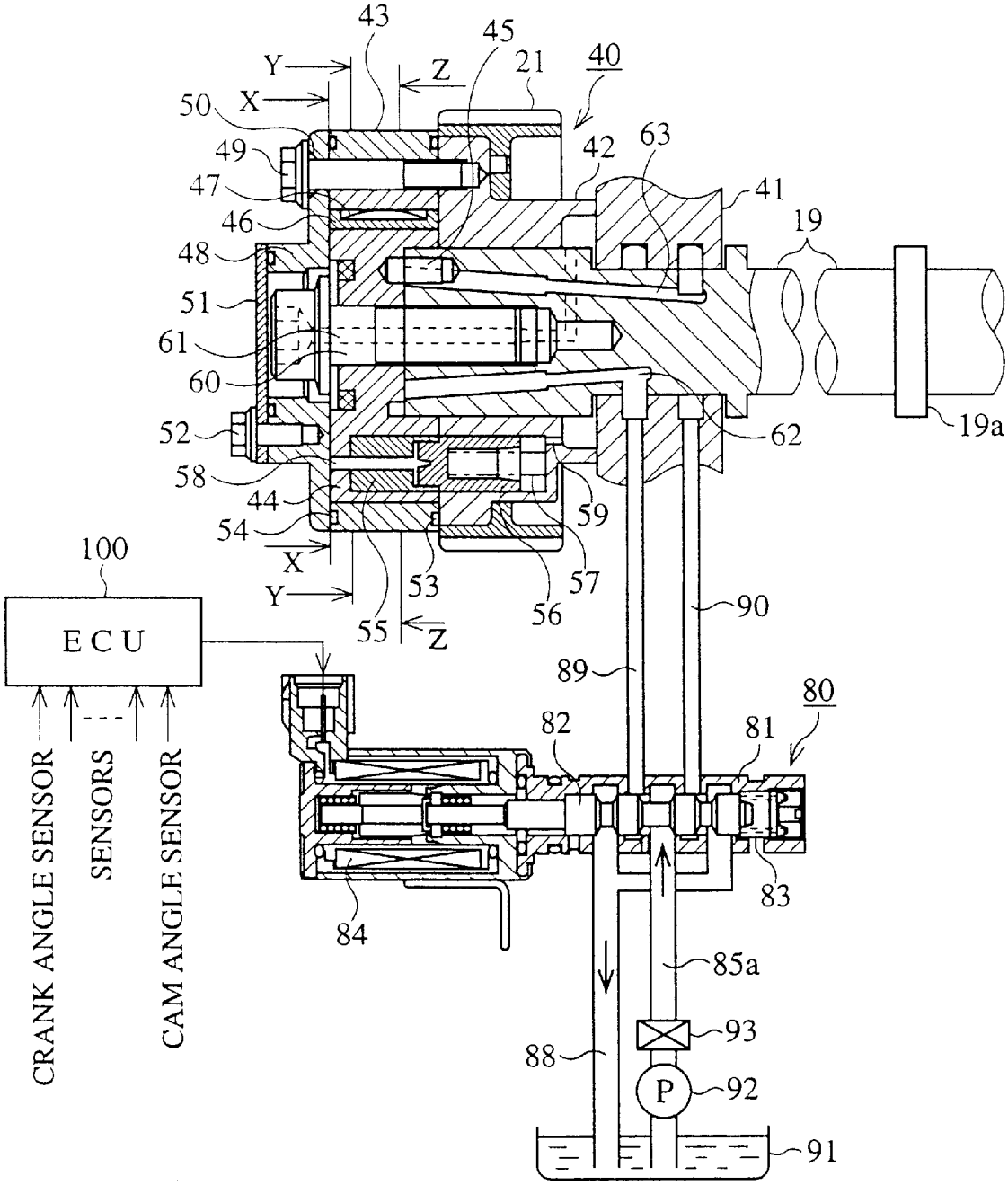
FIG.18 PRIOR ART
FIG. 18 is a cross sectional view of the vane type hydraulic actuator in the prior art.
Figure 19:
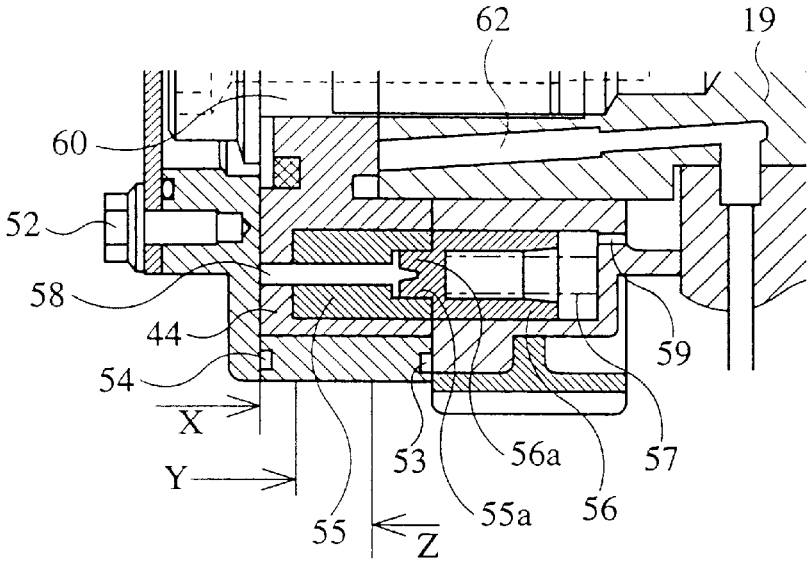
FIG.19 PRIOR ART
FIG. 19 is a detailed cross sectional view of the plunger portion in FIG. 18.
Figure 20:
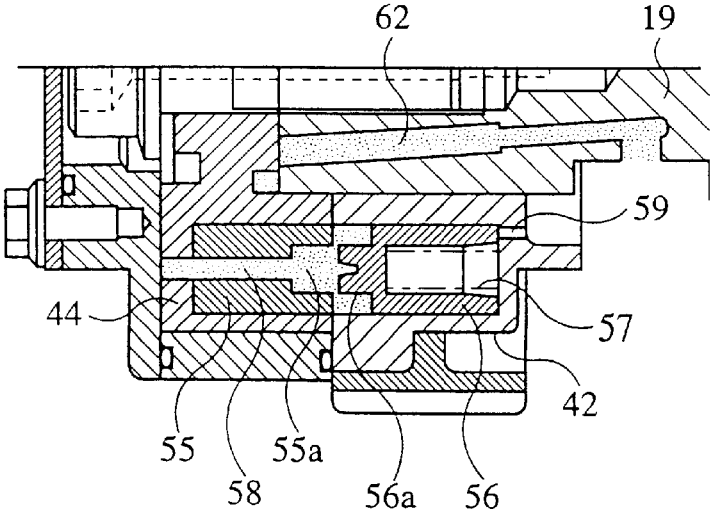
FIG.20 PRIOR ART
FIG. 20 is a cross sectional view of the plunger portion at a state that an oil pressure is applied to the plunger.
Figure 21:
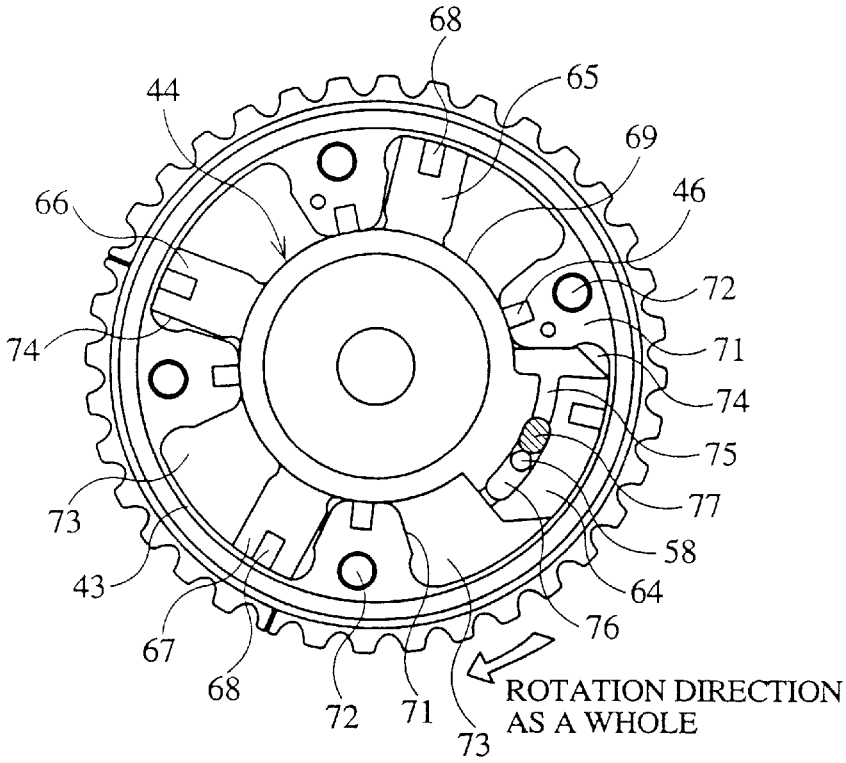
FIG.21 PRIOR ART
FIG. 21 is a cross sectional view of FIG. 18 along the line X—X.
Figure 22:
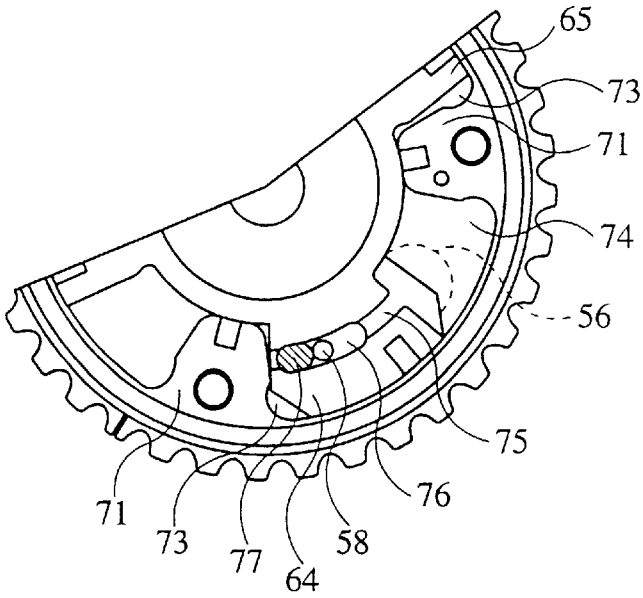
FIG.22 PRIOR ART
FIG. 22 is a partial sectional view of FIG. 21, at a state that the slide plate is displaced.
Figure 23:
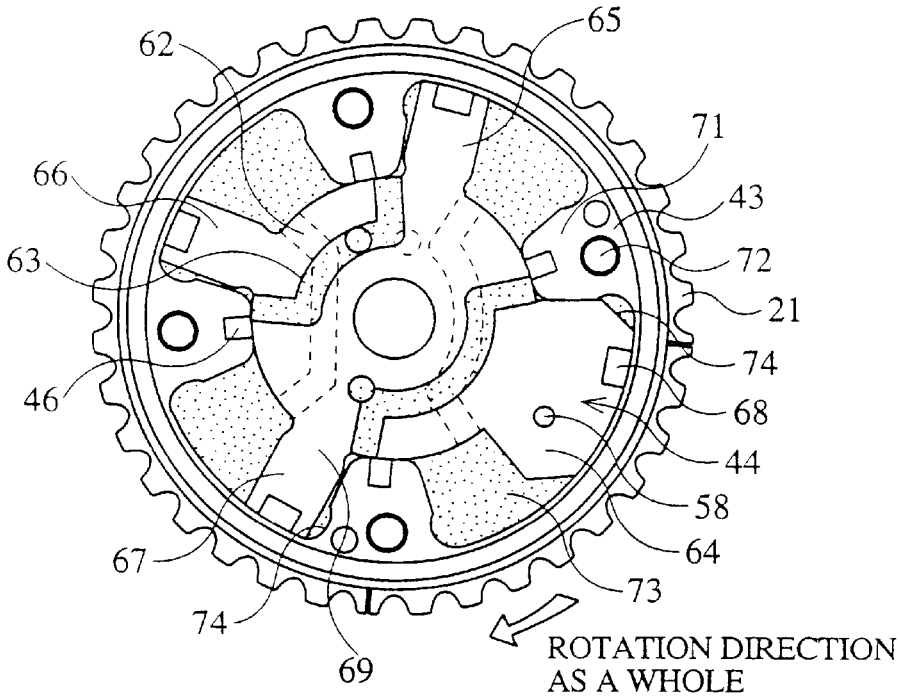
FIG.23 PRIOR ART
FIG. 23 is a cross sectional view of FIG. 18 along the line Y—Y.
Figure 24:
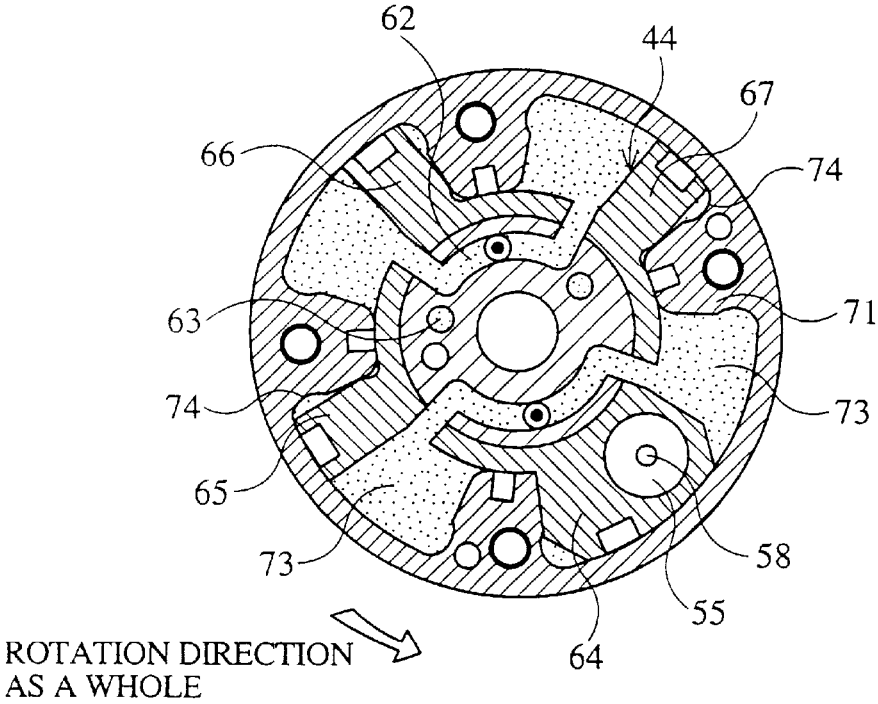
FIG.24 PRIOR ART
FIG. 24 is a cross sectional view of FIG. 18 along the line Z—Z.

The vane type hydraulic actuator according to the seventh embodiment of the present invention is explained below, referring to FIGS. 16, 17. Components in FIGS. 16, 17 identical or equivalent to those in FIGS. 1 to 9 and 13 to 15 are referred to the same reference numerals, and their explanations are omitted.

In the sixth embodiment, the guide stopper pin 101 and the retaining stopper pin 104 are disposed in a common shoe 71 of case 43 so as to be adjacent in the direction of the rotor 44. On the other hand, in the seventh embodiment, the guide stopper pin 101 (guide locking means) and the retaining stopper pin 104 (retaining locking means) are disposed on different shoes 71, which are located symmetrically in respect with the axis of the rotor 44. The guide stopper pin 101 and the retaining stopper pin 104 are configured symmetrically-in respect with the axis of the rotor 44 and can slide in the radial direction of the rotor 44.

The first engaging recess 142*a* for disengageably receiving the first engaging boss 101*a* of the guide stopper pin 101 and the second engaging recess 142*b* for disengageably receiving the second engaging boss 104*a* of the retaining stopper pin 104 are disposed in the hub portion of the rotor 44 symmetrically in respect with the axis of the rotor 44.

The functions of the guide stopper pin 101 and the retaining stopper pin 104 are similar to those of the sixth embodiment, thus, their explanation is omitted.

According to the seventh embodiment, advantages can be obtained in that the longitudinal length of the hydraulic actuator can be shortened compared to that of the sixth embodiment, in which the guide stopper pin 101 and the retaining stopper pin 104 are disposed adjacent in the direction of the rotor axis. Because, in the seventh embodiment, the guide stopper pin 101 and the retaining stopper pin 104 are disposed symmetrically in respect with the rotor axis, and the first engaging recess 142*a* for disengageably receiving the first engaging boss 101*a* of the guide stopper pin 101 and the second engaging recess 142*b* for disengageably receiving the second engaging boss 104*a* of the retaining stopper pin 104 are disposed in the hub portion of the rotor 44 symmetrically in respect with the axis of the rotor 44. As a result, the hydraulic actuator 40 can be downsized. Further, the weight of the hydraulic actuator 40 can be balanced, because the guide stopper pin 101 and the retaining stopper pin 104 are disposed symmetrically in respect with the rotor axis, as explained above, therefore the rotation of the actuator 40 can be stabilized.

What is claimed is:

1. A vane type hydraulic actuator comprising:

a case having a plurality of shoes and being installed on a cam shaft of an engine so as to be rotatable independently therefrom;

a rotor having a plurality of vanes and being received in the case, the rotor is fixed to the cam shaft of the engine and is rotatable relatively to the case in a predetermined angle region;

oil pressure chambers for timing retard and for timing advance disposed between the vanes of the rotor and the shoes of the case;

and a locking means for retaining the rotor to the case so that the relative rotation between the case and the rotor is prevented;

wherein the length in the peripheral direction of the tip portion of the vane having the locking means is substantially identical to that of the vane, which is located symmetrically opposite with the vane having the locking means with respect to the axis of the rotor;

and the length in the peripheral direction of the tip portion of the other vanes is shorter than that of the vane having the locking means.

* * * * *